US009372037B2

(12) United States Patent
Gromes, Sr.

(10) Patent No.: US 9,372,037 B2
(45) **Date of Patent: *Jun. 21, 2016**

(54) METHOD AND APPARATUS FOR CLEANING ELONGATED TUBES

(71) Applicant: Terydon, Inc., Navarre, OH (US)

(72) Inventor: Terry D. Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 228 days.

This patent is subject to a terminal disclaimer.

(21) Appl. No.: 14/135,845

(22) Filed: Dec. 20, 2013

(65) Prior Publication Data

US 2014/0109936 A1 Apr. 24, 2014

Related U.S. Application Data

(62) Division of application No. 12/917,925, filed on Nov. 2, 2010, now Pat. No. 8,628,629.

(51) Int. Cl.

| | |
|---|---|
| ***F28G 1/16*** | (2006.01) |
| ***F28G 15/00*** | (2006.01) |
| ***B08B 9/043*** | (2006.01) |
| ***F28G 15/02*** | (2006.01) |
| ***F28G 15/04*** | (2006.01) |
| ***B05B 13/04*** | (2006.01) |
| ***B05B 13/06*** | (2006.01) |

(52) U.S. Cl.

CPC ..... *F28G 1/163* (2013.01); *B05B 13/041* (2013.01); *B05B 13/0627* (2013.01); *B08B 9/0433* (2013.01); *F28G 15/003* (2013.01); *F28G 15/02* (2013.01); *F28G 15/04* (2013.01); *B05B 13/0436* (2013.01)

(58) Field of Classification Search

CPC ..... B08B 9/0433; F28G 1/163; F28G 15/003; F28G 15/04; F28G 15/02; B05B 13/0627; B05B 13/041; B05B 13/0436

See application file for complete search history.

(56) References Cited

U.S. PATENT DOCUMENTS

| | | | |
|---|---|---|---|
| 2,591,172 | A | 4/1952 | Elving |
| 2,617,191 | A | 11/1952 | Detjen |
| 2,634,812 | A | 4/1953 | Allemang |
| 2,698,449 | A | 1/1955 | Rafferty |
| 2,897,532 | A | 8/1959 | Cantieri |

(Continued)

FOREIGN PATENT DOCUMENTS

| | | |
|---|---|---|
| DE | 102004021500 | 11/2005 |
| EP | 531871 | 3/1993 |

(Continued)

*Primary Examiner* — Michael Barr
*Assistant Examiner* — Benjamin L Osterhout
(74) *Attorney, Agent, or Firm* — Sand & Sebolt

(57) ABSTRACT

A system and method for cleaning elongated tubes is presented. An apparatus for cleaning elongated tubes includes a cart, a lance, a pressure sensing device and a propulsion device. The lance sprays material into elongated tubes to clean the elongated tubes. The cart supports the lance while the cart is moves in a rail in a forward direction and in a reverse direction. The pressure sensing device is located in the cart detects a pressure exerted on the cart as the cart moves in a forward direction in the rail. The propulsion device, upon the pressure sensing device detecting a pressure crossing a threshold value, propels the cart in the reverse direction for predetermined distance or time before again propelling the first cart in the forward direction.

19 Claims, 23 Drawing Sheets

(56) References Cited

U.S. PATENT DOCUMENTS

| | | | |
|---|---|---|---|
| 3,157,903 | A | 11/1964 | Matthews |
| 3,174,179 | A | 3/1965 | Benson |
| 3,389,713 | A | 6/1968 | Pittman |
| 3,581,341 | A | 6/1971 | Perry |
| 3,901,252 | A | 8/1975 | Riebe |
| 3,938,535 | A | 2/1976 | Cradeur et al. |
| 4,079,892 | A | 3/1978 | Hodgson |
| 4,095,305 | A | 6/1978 | Goodwin |
| 4,219,976 | A | 9/1980 | Burack et al. |
| 4,893,566 | A | 1/1990 | Fukuda |
| 5,031,691 | A | 7/1991 | Boisture |
| 5,549,079 | A | 8/1996 | Johnston et al. |
| 5,695,098 | A | 12/1997 | King |
| 5,735,964 | A | 4/1998 | Amuny |
| 5,866,085 | A | 2/1999 | Yelvington |
| 5,913,769 | A | 6/1999 | Byma et al. |
| 7,066,291 | B2 | 6/2006 | Martins et al. |
| 7,118,366 | B2 | 10/2006 | Grimm et al. |
| 7,520,662 | B2 | 4/2009 | Farrell |
| 2004/0006841 | A1 | 1/2004 | Jameel et al. |
| 2010/0126540 | A1 | 5/2010 | Geppert et al. |
| 2010/0318241 | A1 | 12/2010 | Post et al. |

FOREIGN PATENT DOCUMENTS

| | | |
|---|---|---|
| FR | 2302331 | 10/1976 |
| FR | 2646274 | 10/1990 |
| JP | 2009269298 | 11/2009 |

METHOD AND APPARATUS FOR CLEANING ELONGATED TUBES

CROSS REFERENCE TO RELATED APPLICATION

This application is a divisional of U.S. patent application Ser. No. 12/917,925, filed Nov. 2, 2010; the disclosure of which is incorporated herein by reference.

BACKGROUND OF THE INVENTION

1. Technical Field

The present invention relates generally to apparatus and methods for cleaning elongate tubes. More particularly, the apparatus and methods relate to using a lance to spray high pressure water into elongated tubes. Specifically, the apparatus and methods of the present invention relate to guiding a lance into elongated tubes by opening and closing doors supporting the lance.

2. Background Information

Heat exchangers are used for the transfer of heat from one fluid medium to another. One of the fluids passes through a series of conduits, or elongated tubes, while the other passes on the outside of the tubes. During this process, carbonaceous and other deposits form on the interior of the individual tubes. Debris and other dirt collects on the surface of the individual tubes. To maintain efficient operation, it is necessary to periodically remove the tubes and clean their interior and exterior surfaces.

One method of cleaning the interior of heat exchanger tubes includes the progressive insertion of a small diameter tube, known as a lance, into the heat exchanger tube and the pumping of high pressure water through the lance to clean the interior of the tube. The water pressure in a lance may easily exceed 10,000 psi with flow rates in excess of 100 gallons per minute. There are problems inherent in using a lance to clean heat exchangers. For example, it is very difficult to keep the lance from buckling and bending while it is being guided into the tube. A more serious problem, however, is jet reaction from the high pressure stream. Since the fluid is forced through the lance at extremely high pressures (in excess of 10,000 psi) the fluid discharge from the lance tip can frequently blow backward and strike the operators guiding the lance.

One apparatus used to clean heat exchangers supports the rear portion of the lance in an elongated channel member which has an open top. The front end (operating end) of each lance is fed into the tube through a vertical separator plate positioned at the front end of the channel member. The drive means comprises a set of motor-driven friction rollers which engage the lances immediately behind the separator plate. The major portion of the lance is supported in the open channel member behind the drive rollers and the motor. However, in these types of apparatus the lance can be quite long and hard to accurately position as it travels on the channel member. Therefore, improved heat exchanger cleaning technology is desired.

SUMMARY

The preferred embodiment is an apparatus for cleaning elongated tubes. The apparatus includes a cart, a lance, and a pressure sensing device and a propulsion device. The lance sprays material into elongated tubes to clean the elongated tubes. The cart supports the lance while the cart is moves in a rail in a forward direction and in a reverse direction. The pressure sensing device is located in the cart and detects a pressure exerted on the cart as the cart moves in a forward direction in the rail. The propulsion device, upon the pressure sensing device detecting a pressure crossing a threshold value, propels the cart in the reverse direction for predetermined distance or time before again propelling the first cart in the forward direction.

Another configuration of the preferred embodiment is a method of cleaning elongated tubes. A cart holding a lance is propelled through a rail in a forward direction. Material is sprayed out of the lance to clean an elongated tube. During this process a pressure may be applied to the cart and this pressure may cross a threshold value. In response to the pressure crossing the threshold, the cart stopped and backed up in backward direction for a distance. This distance may be a predetermined distance or the cart can back up for a time period. After backing the cart up the distance, the cart is again moved in the forward direction to continue cleaning the elongated tube.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE INVENTION

Figure 1:
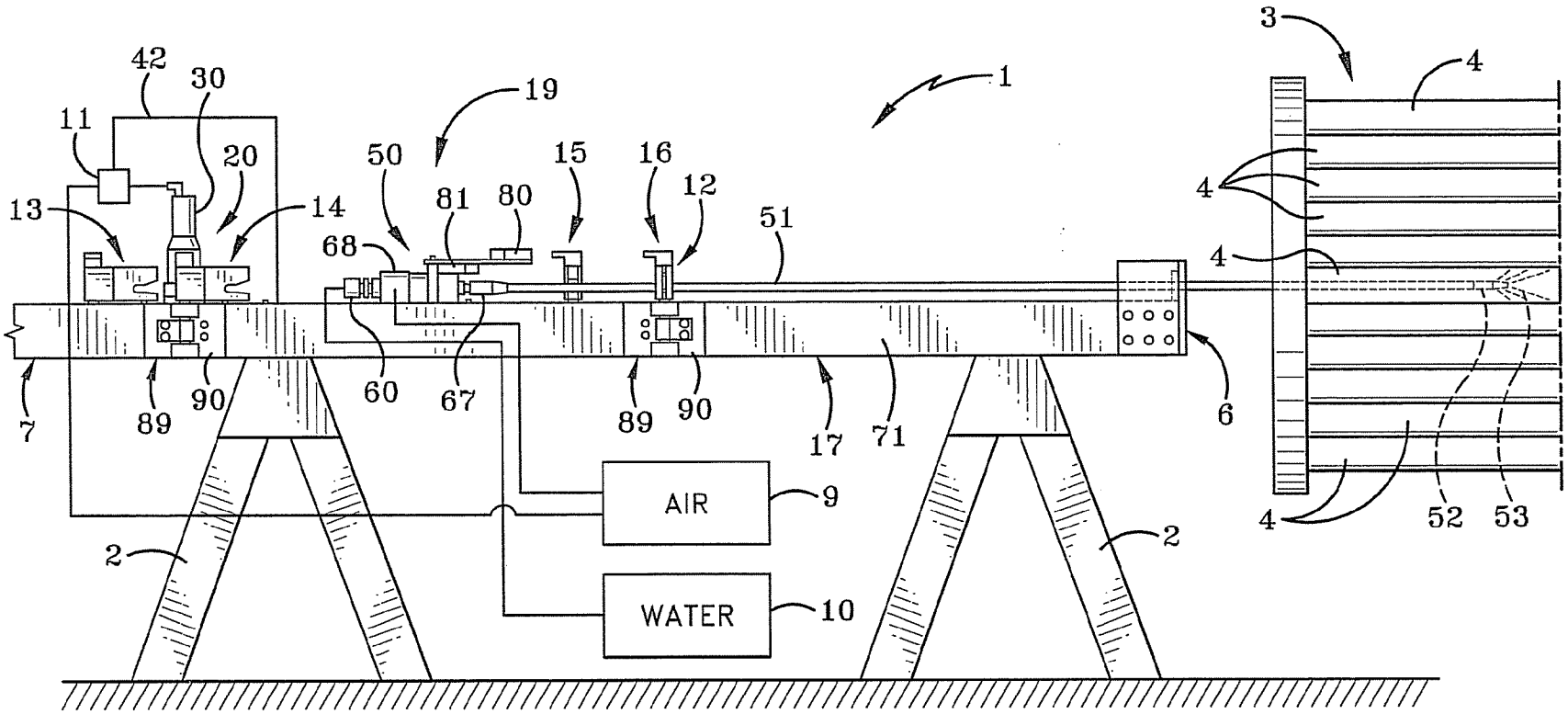
FIG. 1 illustrates an example environment in which a preferred embodiment of an apparatus for cleaning elongated tubes operates.
Figure 2:
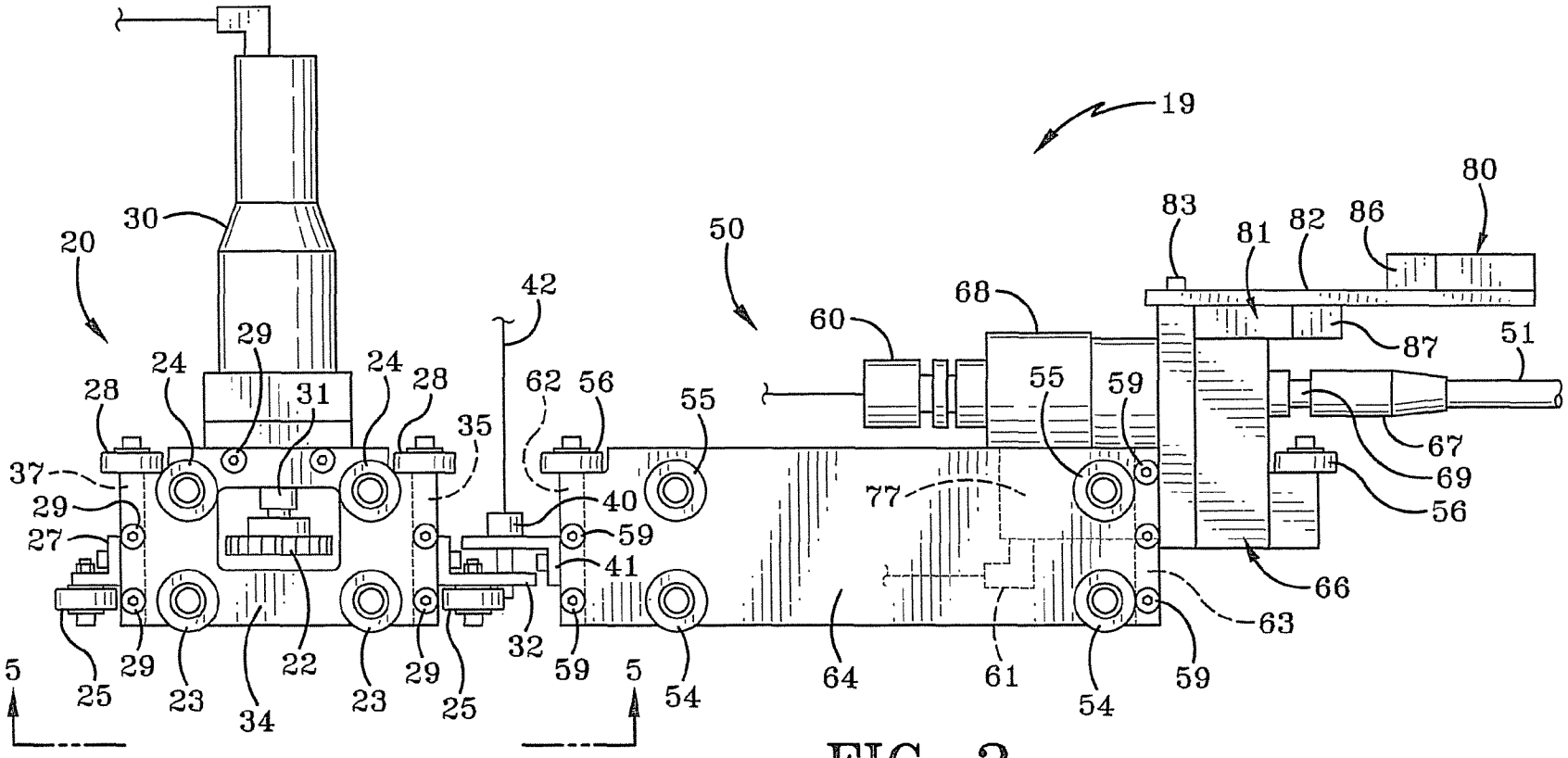
FIG. 2 illustrates an example side view of a motorized cart and a lance cart of the preferred embodiment.
Figure 3:
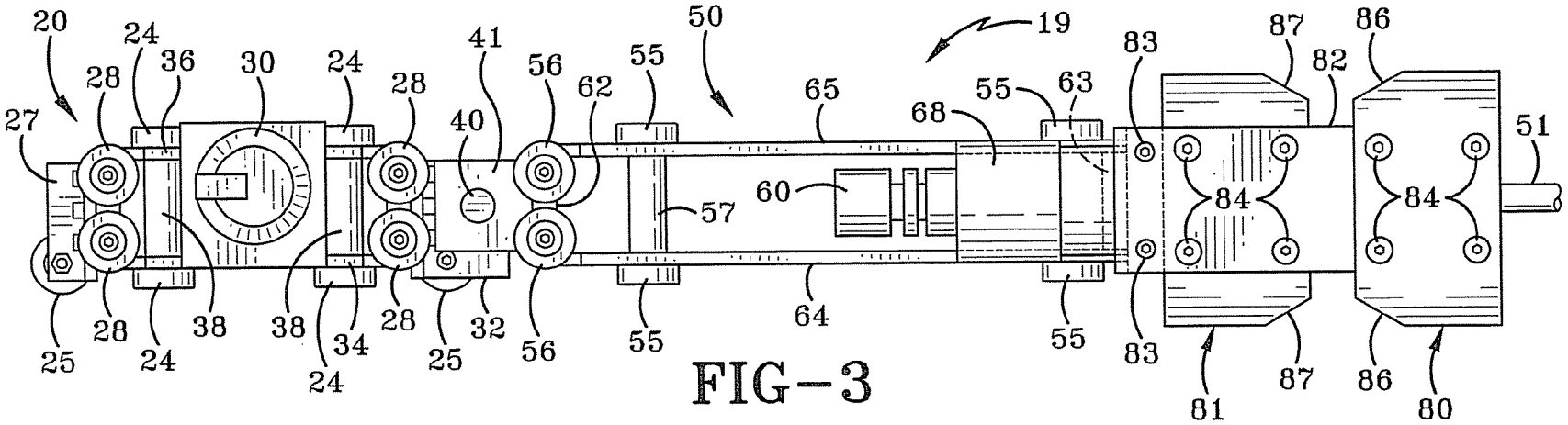
FIG. 3 illustrates an example top view of the motorized cart and the lance cart of the preferred embodiment.
Figure 5:
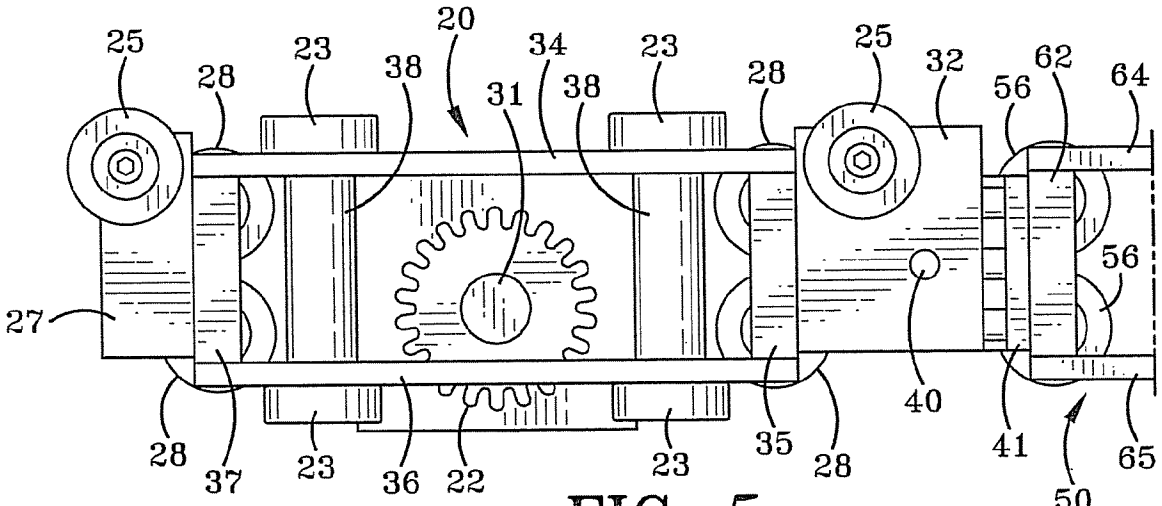
FIG. 5 illustrates an example bottom view of the motorized cart and the lance cart of the preferred embodiment.

FIG. 1 illustrates a tube cleaning apparatus 1 resting on two support structures 2 while cleaning one of the tubes 4 of a heat exchanger 3. Those of ordinary skill in the art will appreciate that the tube cleaning apparatus 1 can be mounted in a mechanical rack that is sturdy enough to support the apparatus 1 and to provide for the rapid repositioning of the apparatus 1 to other positions to clean other tubes 4 of the heat exchanger 3. The tube cleaning apparatus 1 includes a rail 17 (e.g., channel) with a front end 6 and a back end 7, and a tube cleaning cart system 19. The tube cleaning cart system includes a motorized cart 20 and a lance cart 50 mounted with a lance 51. The carts 20, 50 are made out of solid material such as a metal and are best seen in FIGS. 2, 3 and 5. The motorized cart 20 includes a left side wall 34, right side wall 36, front side wall 35 and a back side wall 37. Similarly, the lance cart 50 includes a left side 64, a right side 65 a front side 63 and a back side 62.

FIG. 1 also illustrates four door assemblies 13, 14, 15, 16 attached to the rail 17. In the preferred embodiment, the door assemblies 13, 14, 15, 16 are equally spaced from each other and evenly distributed the length of the rail 17. One of ordinary skill in the art will appreciate that FIG. 1 illustrates four door assemblies 13, 14, 15, 16; however, fewer than four doors or more than four doors can be attached to the rail 17. As discussed in detail below, the door assemblies 13, 14, 15, 16 support the lance 51 as it travels forward and backward in the rail 17. Also as discussed in detail below, as the lance cart 50 approaches a door moving in the forward direction toward the back end 7 of the rail, the door is opened. When the lance cart 50 approaches a door moving in the reverse direction toward the front end 6 of the rail, the door is closed.

A supply of high pressure water 10 and/or high pressure air 9 is connected to the motorized cart 20 and to the lance cart 50. FIG. 2 illustrates the water line connector 60 and the air line connector 61 on the lance cart 50. The high pressure water and/or air can be used as a material that is ejected from a tip 52 of the lance 51 at high pressure as a spray 53 to clean unwanted materials from the tubes 4. The water and/or pneumatic oil can also be used as an energy source to propel the two carts 20, 50 in the rail 17 so that the lance 51 can be inserted into the tubes 4 and removed from the tubes 4 of the heat exchanger 3. Water may generally exit the lance tip 52 at 10,000 to 40,000 psi. The water may be connected to a controller 11 of the motorized cart 20. The controller 11 can regulate the amount of air and/or pneumatic oil received at a cart motor 21 to regulate the speed that the motorized cart 31 that propels the lance cart 50.

Figure 6:
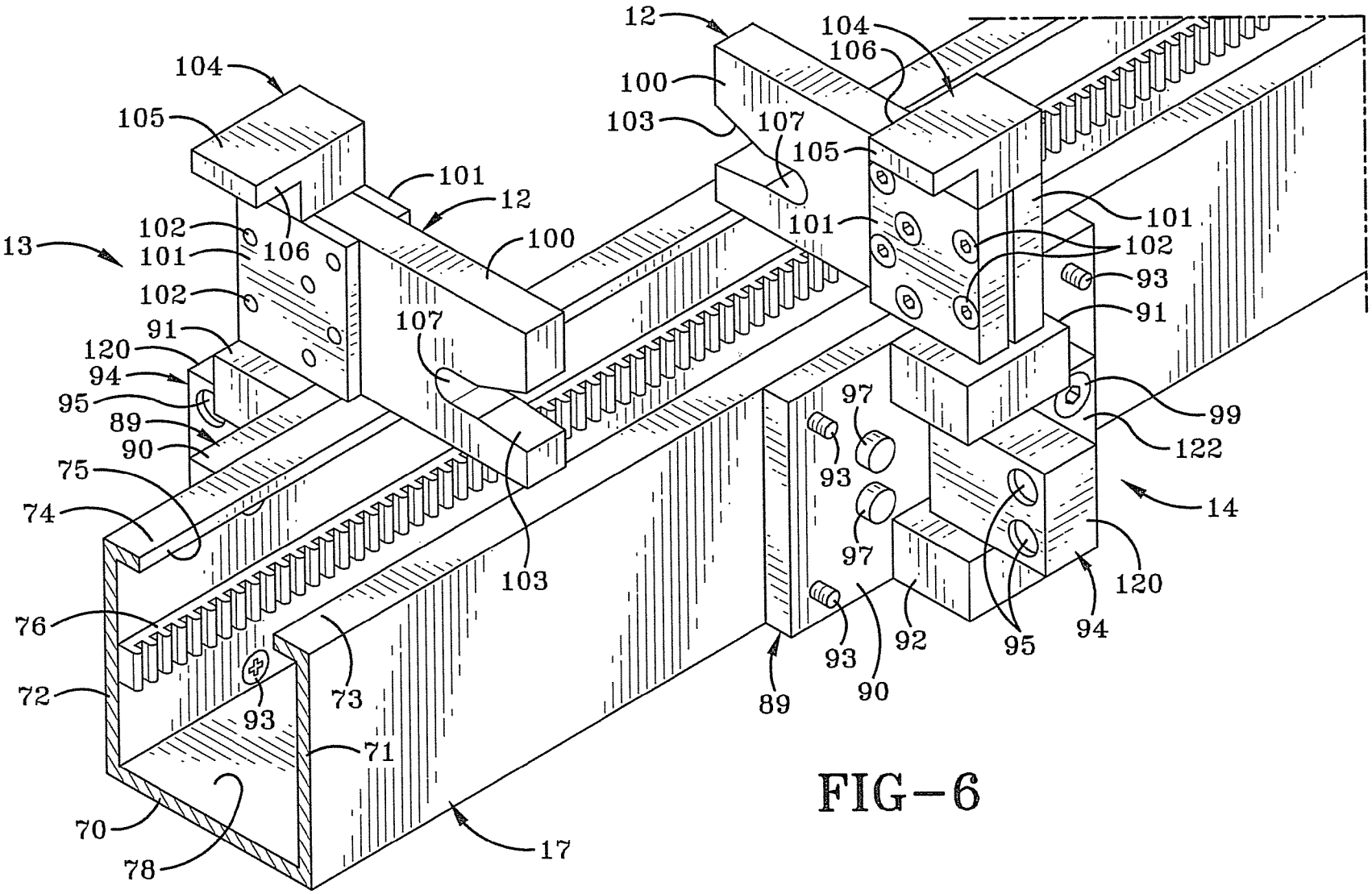
FIG. 6 illustrates an example perspective view of a rail and two doors of the preferred embodiment.
Figure 11:
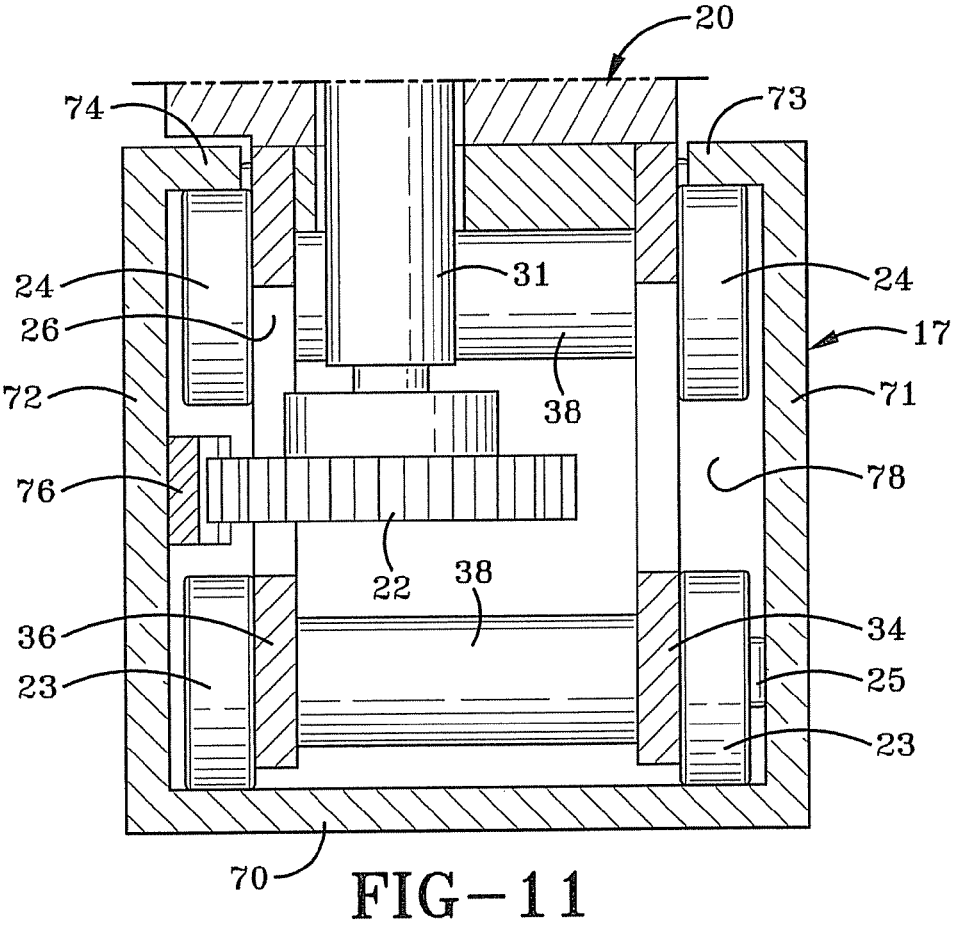
FIG. 11 illustrates an example cross-sectional view of the motorized cart of the preferred embodiment taken at line 11 in FIG. 10.

FIG. 6 illustrates that in the preferred embodiment, a cross-section of the rail 17 is C-shaped with an open top 75 that allows the lance 51 to project out of the open top 75. The rail 17 is a rectangle shape with a flat bottom wall 70, a left side wall 71, a right side 72 and a pair of upper lips 73 and 74 projecting inward from the tops of the sides 71, 72. These walls form an inner channel chamber 78. The left side wall 71 of the rail 17 has a gear rack 76 running generally the length of the rail 17. As best shown in FIG. 11, this provides for a drive gear 22 in the motorized cart 20 to engaged the gear rack 76 and, thus, propel the motorized cart 20 and lance cart 50 across the rail 17. An opening is 26 formed in the right side wall 36 of the motorized cart 20 and the drive gear 22 extends from this opening 26 to engage the gear rack 76.

Figure 10:
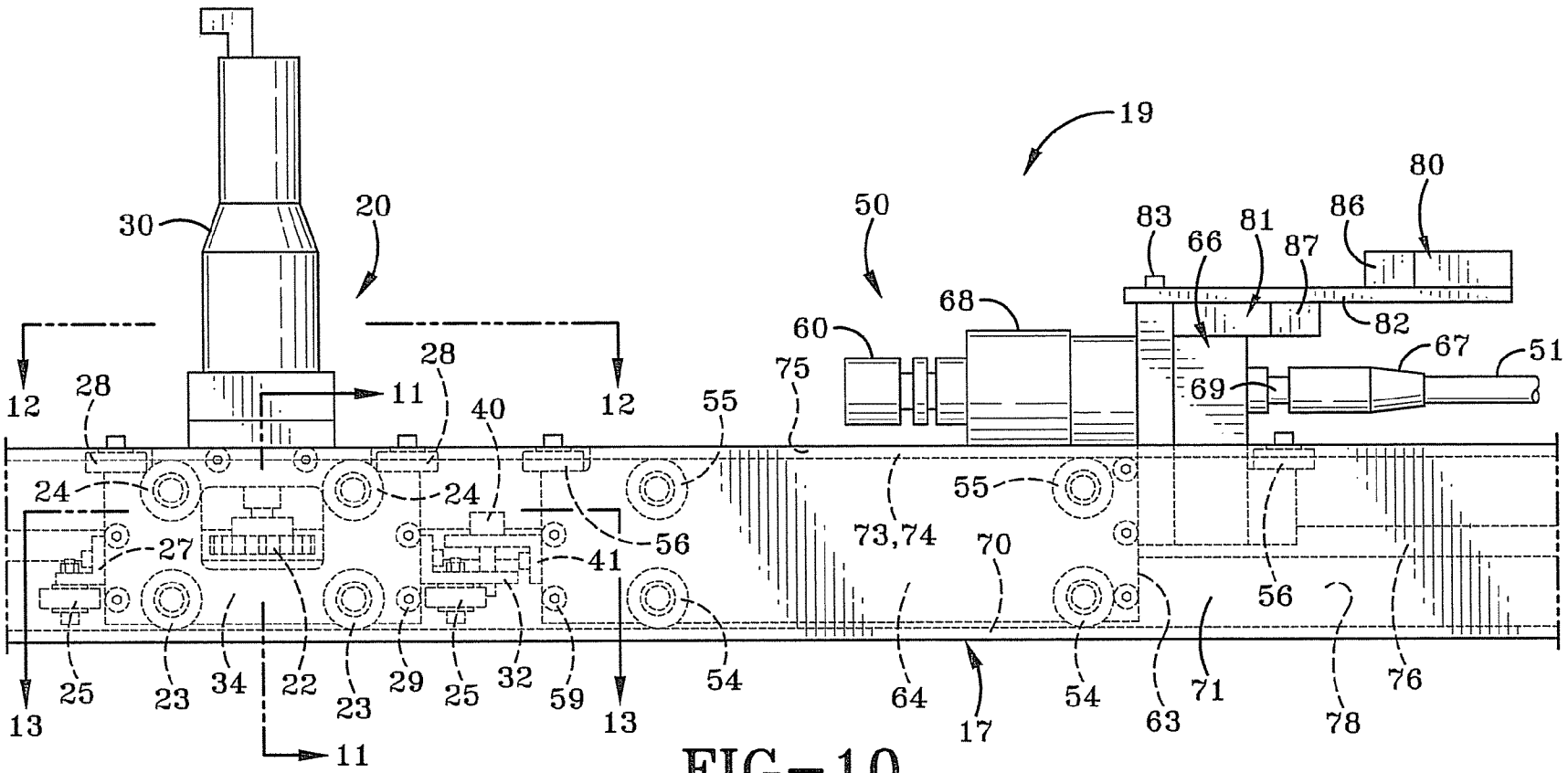
FIG. 10 illustrates an example internal side of a motorized cart and a lance cart of the preferred embodiment as viewed through the rail.
Figure 12:
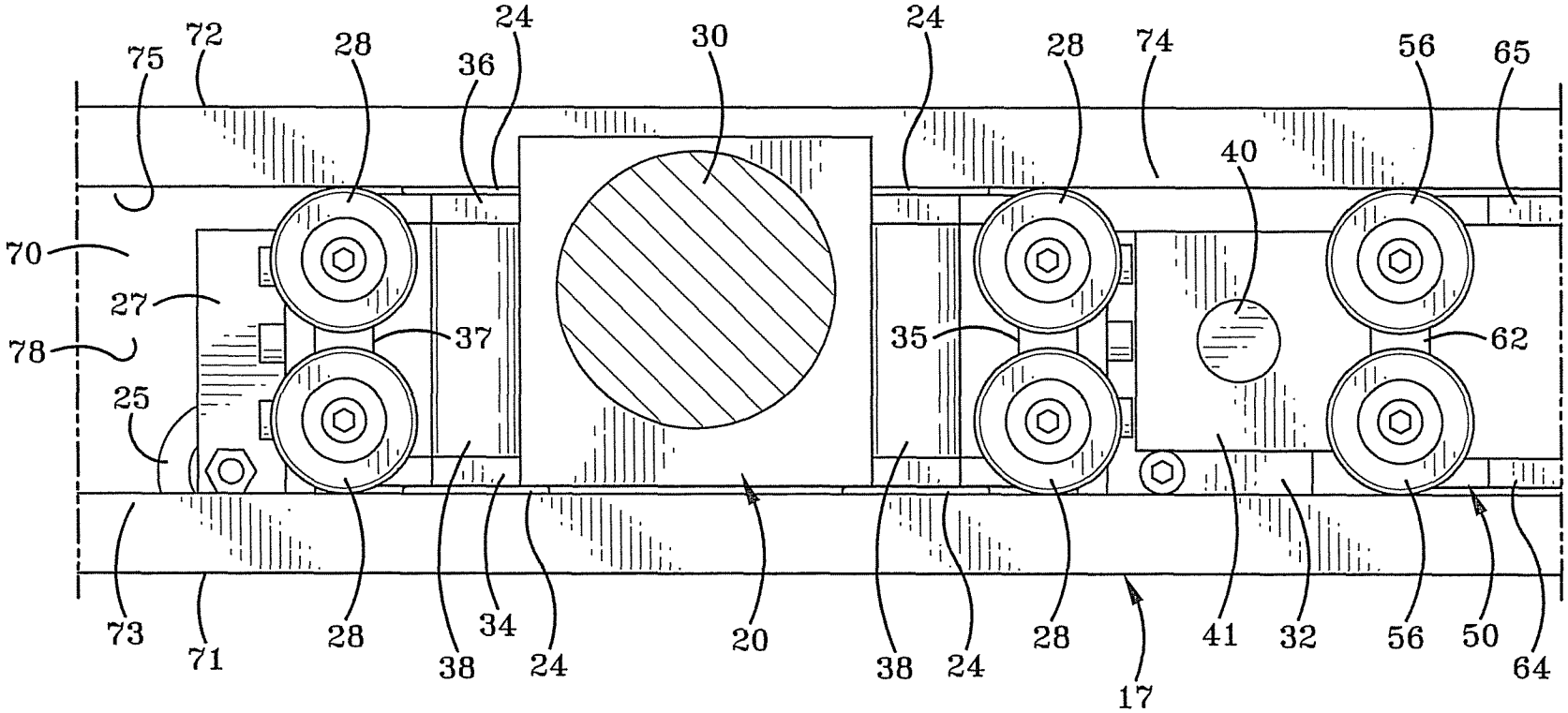
FIG. 12 illustrates an example cross-sectional view of the motorized cart of the preferred embodiment taken at line 12 in FIG. 10.
Figure 13:
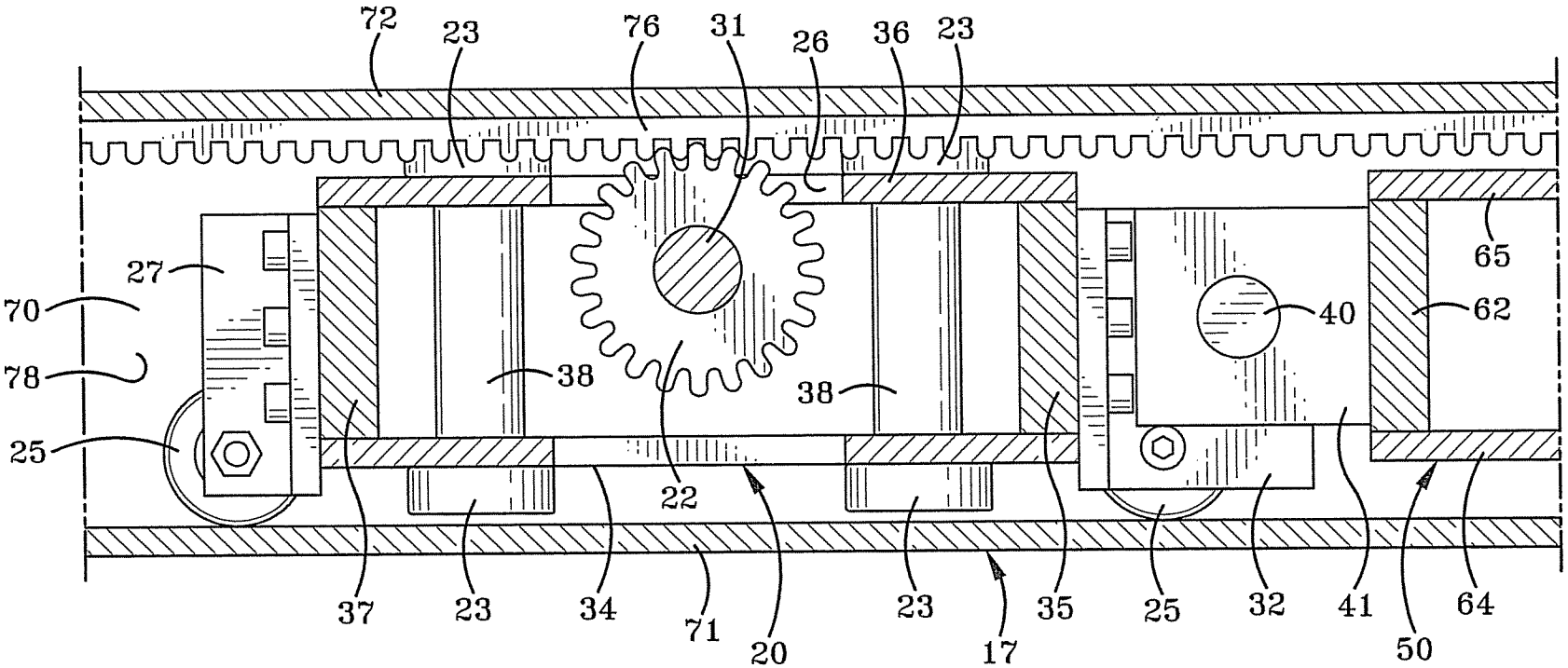
FIG. 13 illustrates an example cross-sectional view of the motorized cart of the preferred embodiment taken at line 13 in FIG. 10.

As best seen in FIG. 10, a variety of wheels mounted on the motorized cart 20 and the lance cart 50 ensure the carts 20, 50 travel securely within the rail 17. Lower motorized cart wheels 23 and lower lance cart wheels 54 travel along the bottom 70 of rail 17. Upper motorized cart wheels 24 and upper lance cart wheels 55 travel along a bottom surface of the upper lips 73, 74. Wall motorized cart wheels 25 mounted to the motorized cart 20 with angle bars 27, 32 travel along the inside surface of the right side 72. Motorized cart lip wheels 28 and lance cart lip wheels 56 travel along inside edges of the upper lips 72, 73 of the rail 17. The motorized cart 20 is held together by bolts 29 and the lance cart 50 is held together by bolts 59.

A motor 30 is mounted to the top of the motorized cart 20. The motor 30 may be a hydraulic or pneumatic motor. A drive shaft 31 (FIG. 2) connects the drive gear 22 with the motor 30. A coupling 40 connected between the angle bar 32 on the motorized cart 20 and an angle bar 41 on the lance cart 50 connects the carts 20, 50 together. This connector 40 may be a pressure sensitive connector that monitors the pressure between the two carts and sends a pressure indicator to the controller 11 through a feedback line 42. In other configurations, a pressure indication can be mechanically feedback directly to the motor 30 (or other motor regulator).

The lance cart 50 includes a lance mounting bracket 66 (FIG. 2) supporting a lance gear box 77, a drive assembly 68, and a lance coupling 69. The lance gear box 77 is coupled to the drive assembly 68 with a drive belt so that this assembly is configured to mechanically spin the lance 51. The lance coupling 69 is attached to a lance connector 67. The lance connector 67 allows the lance 51 to be easily attached and removed from the lance cart 50. The lance cart 50 also includes a top door pusher 80 and a bottom door pusher 81. The pushers 80, 81 are made out of polyurethane material and are attached to a pusher mounting bracket 82. The pusher mounting bracket 82 is mounted to the top of the lance mounting bracket 66 with one or more fasteners 83. The bottom door pusher 81 is mounted to the bottom of the pusher mounting bracket 82 while the top door pusher 80 is mounted to the top of the pusher mounting bracket 82. The pushers 80, 81 are fastened to the pusher mounting bracket 82 with one or more bolts 84 or other fasteners. The top door pusher 80 may be formed with beveled corners 86 at the two corners used to push close doors of the door assemblies 13, 14, 15, 16. The bottom door pusher 81 may be formed with beveled corner at the two corners used to push open the doors of the door assemblies 13, 14, 15, 16.

Figure 8:
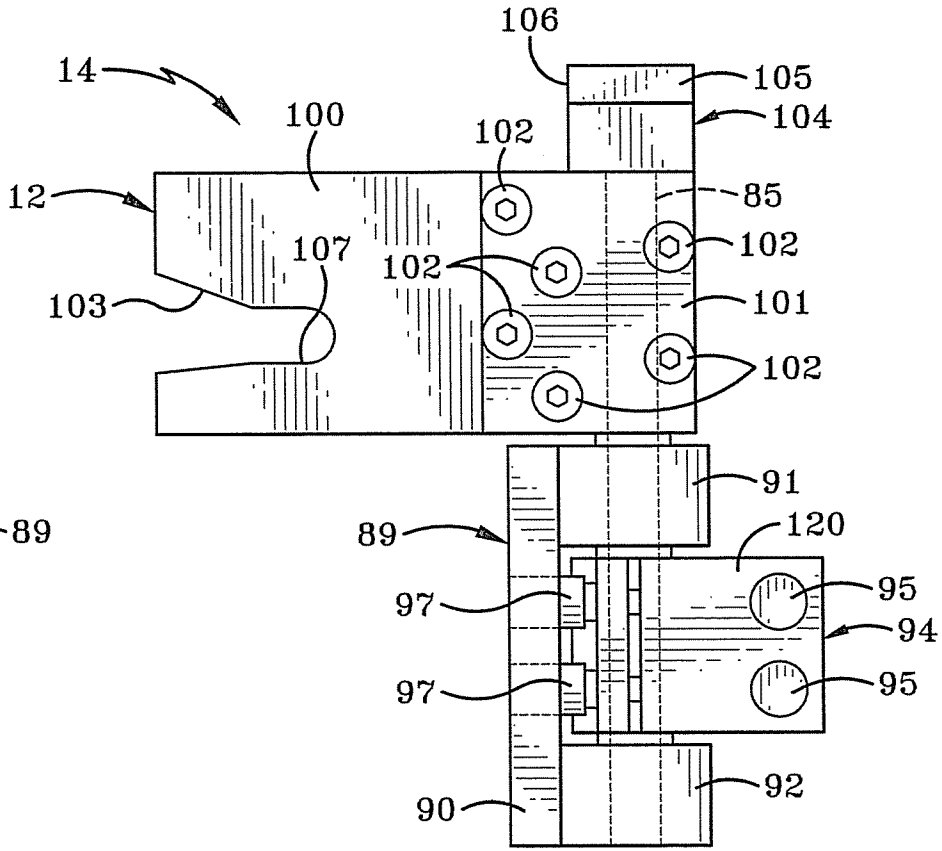
FIG. 8 illustrates an example side view of a door of the preferred embodiment in the open position.
Figure 7:
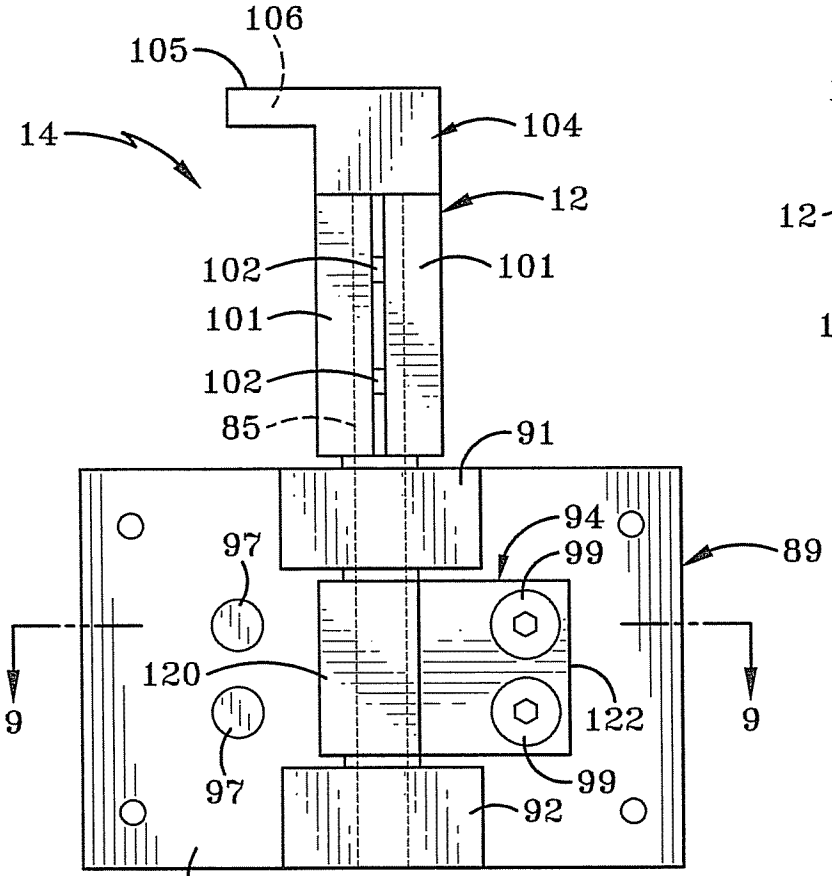
FIG. 7 illustrates an example front view of a door of the preferred embodiment in the closed position.

In the preferred embodiment, the door assemblies 13, 14, 15, 16 are placed on alternating sides of the rail 17. For example, door assemblies 13 and 15 can be placed on the of right side wall 72 the rail 17 as shown in FIG. 1 and door assemblies 14 and 16 can be placed on the left side wall 71. Each door assembly 13, 14, 15, 16 includes a door base 89 and a door 12. This is best seen in FIGS. 7-8 that illustrate door assembly 14. The door base 89 is comprised of mounting blocks 92, 92 attached to a base 90. The door 12 is pivotally mounted with a pivot rod 85 to the door base 89. The pivot rod 85 is passes through the mounting blocks 91, 92. The base 90 is connected to the rail 17 with one or more fasteners 93 that can be bolts. A stop block 94 with a first leg 120 and a second leg 122 (FIG. 9) is also attached to the pivot rod 85 between the mounting blocks 91, 92.

The door 12 includes a lance support 100 that is sandwiched between two lance brackets 101. The lance support 100 is a generally rectangular shaped polymer block with a tapered opening 103 cut out from one sided of the block. The tapered opening 130 further includes a lance support opening where a lance 51 is supported when the door 12 is in the closed position. In operation the tapered opening 103 supports the lance 51 until the door 14 is pushed open by the lance cart 50. The lance brackets 101 are fastened together with fasteners 102 so that the lance support 100 is rigidly attached to the pivot rod. A pusher tab block 104 with a first surface 105 and a second surface 106 is attached to the top of the lance brackets 101.

Figure 9:
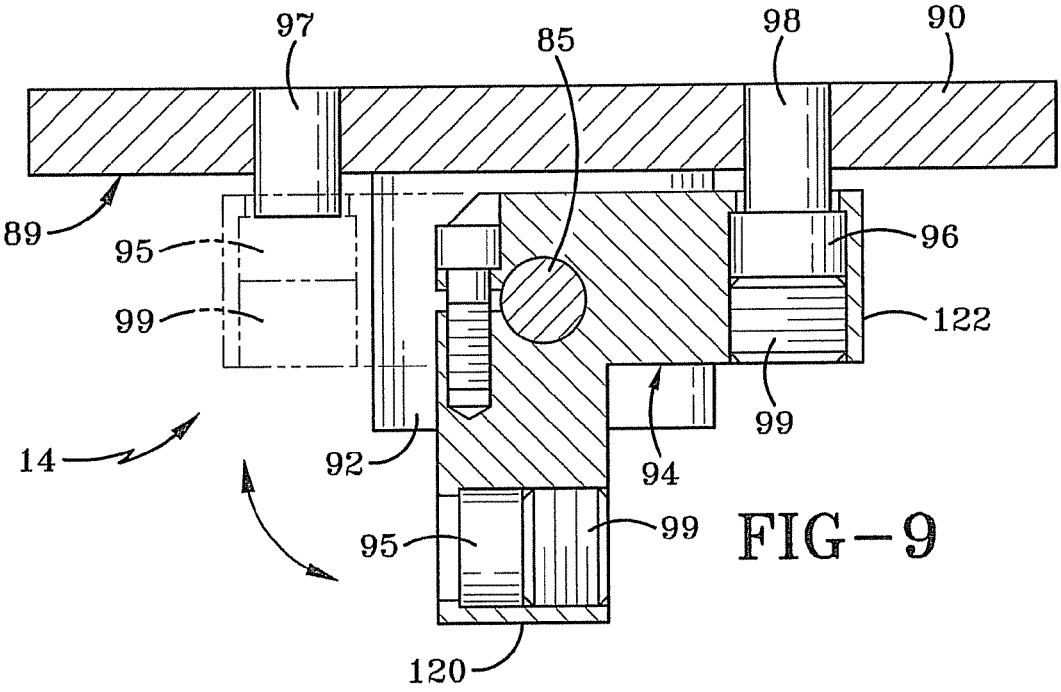
FIG. 9 illustrates an example cross-sectional view of the door of the preferred embodiment taken at line 9 in FIG. 8.

As seen in FIG. 9, two first magnets 95 are located adjacent one surface of the stop block 94. Two different second magnets 96 are located adjacent a second surface of the stop block 94. A filler nut 99 can be inserted opposite the magnets 95, 96. Firsts metal pegs 97 are attached at a first location on the rail 17 and second metal pegs 98 are attached at a second location on the rail 17. The metal pegs 97, 98 are formed with a metal that the magnets 95, 96 are attracted to. When the door 14 of FIG. 6 is in the "closed position" the lance support 100 spans across the upper open portion of the rail 17 and the second magnets 96 are adjacent the second metal pegs 98. When the door 14 of FIG. 6 is in the "open position" the lance support 100 is generally parallel to the left side 72 of the rail 17 and the first magnets 95 are adjacent the first metal pegs 97. The stop block 94 is formed so that the lance support 100 cannot be rotated beyond 90 degrees between the open position and the closed position. The attractive force of the magnets 95, 96 and the metal pegs 97, 98 holds the door 14 in one of the corresponding positions until sufficient force is applied to the door 14 to rotate it toward the other position. Alternative to the metal pegs 97, 98 magnets with a polarity that attracts them to magnets 95, 96 can be used in place of the metal pegs 97, 98.

At the start of an elongated tube 4 cleaning operation, the motorized cart 20 and the lance cart 50 are located near the back side 7 of the rail 17 with both carts 20, 50 between the back side 7 and the first door 13. All the doors 12 are in the closed position. The cleaning operation is started when air and/or water are feed to the motor 30 and the lance cart 50. The motor 30 will drive the drive gear 22 which will rotate while engaged with the gear rack 76 to propel the two carts 20, 50 toward the front end 6 of the rail 71 and the so the lance 51 is inserted into the heat exchanger 3 and high pressure water exiting the lance tip 52 can begin cleaning one of the elongated tubes 4. The lance gear box 77 will rotationally spin the lance 51. This spinning assist in stabilizing the lance 51 as it ejects high pressured water.

Figure 14:
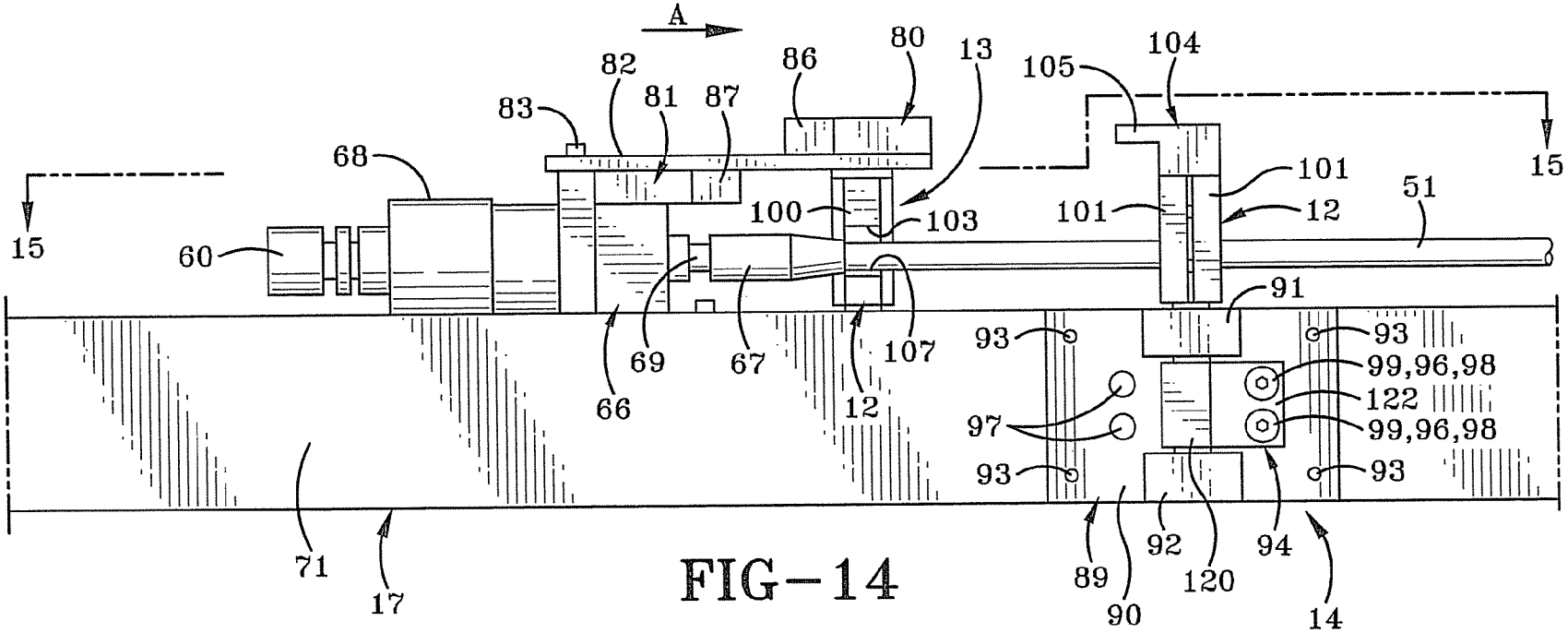
FIG. 14 illustrates an example side view of the lance cart of the preferred embodiment as it approaches a door.
Figure 15:
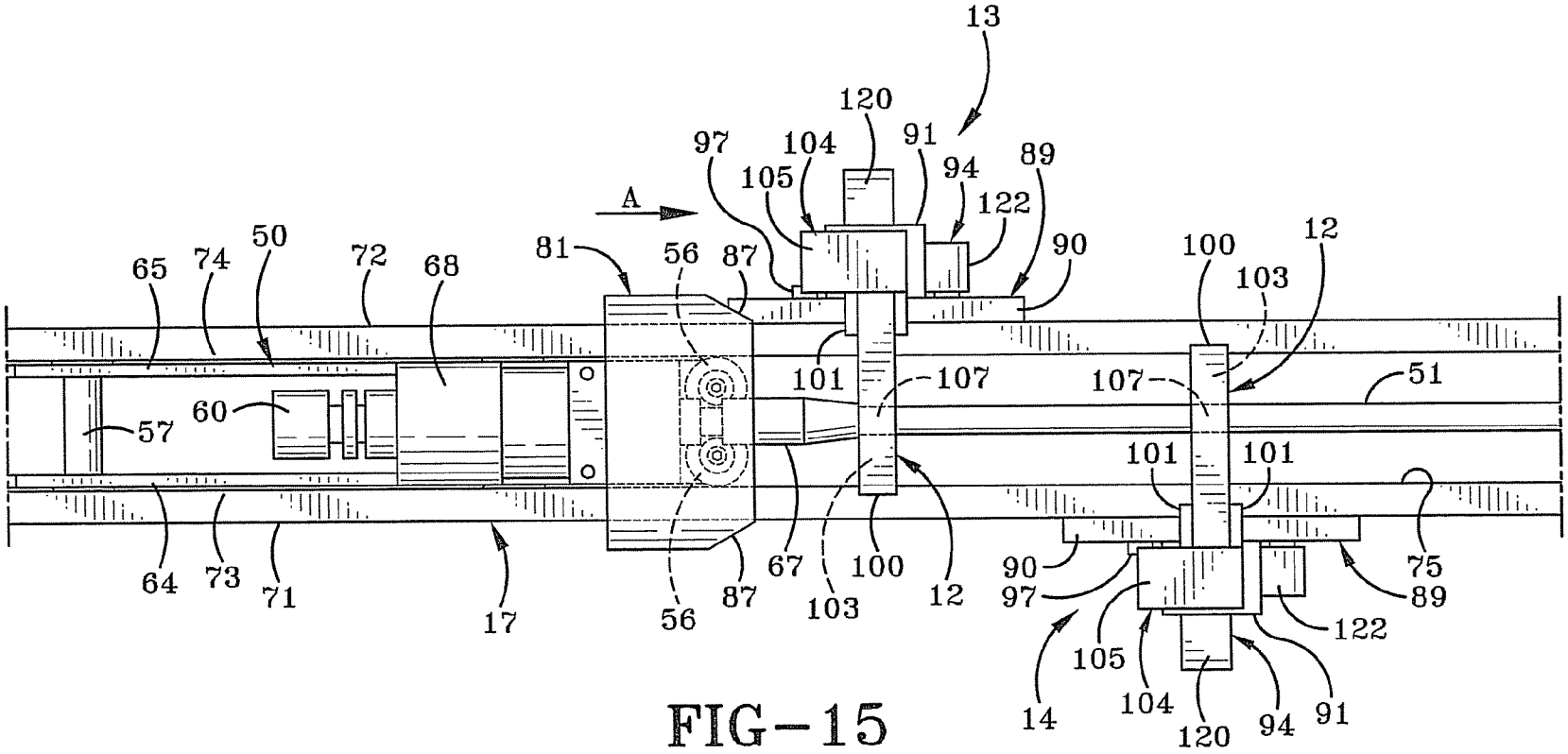
FIG. 15 illustrates an example top view of the lance cart of the preferred embodiment as it approaches the door.
Figure 16:
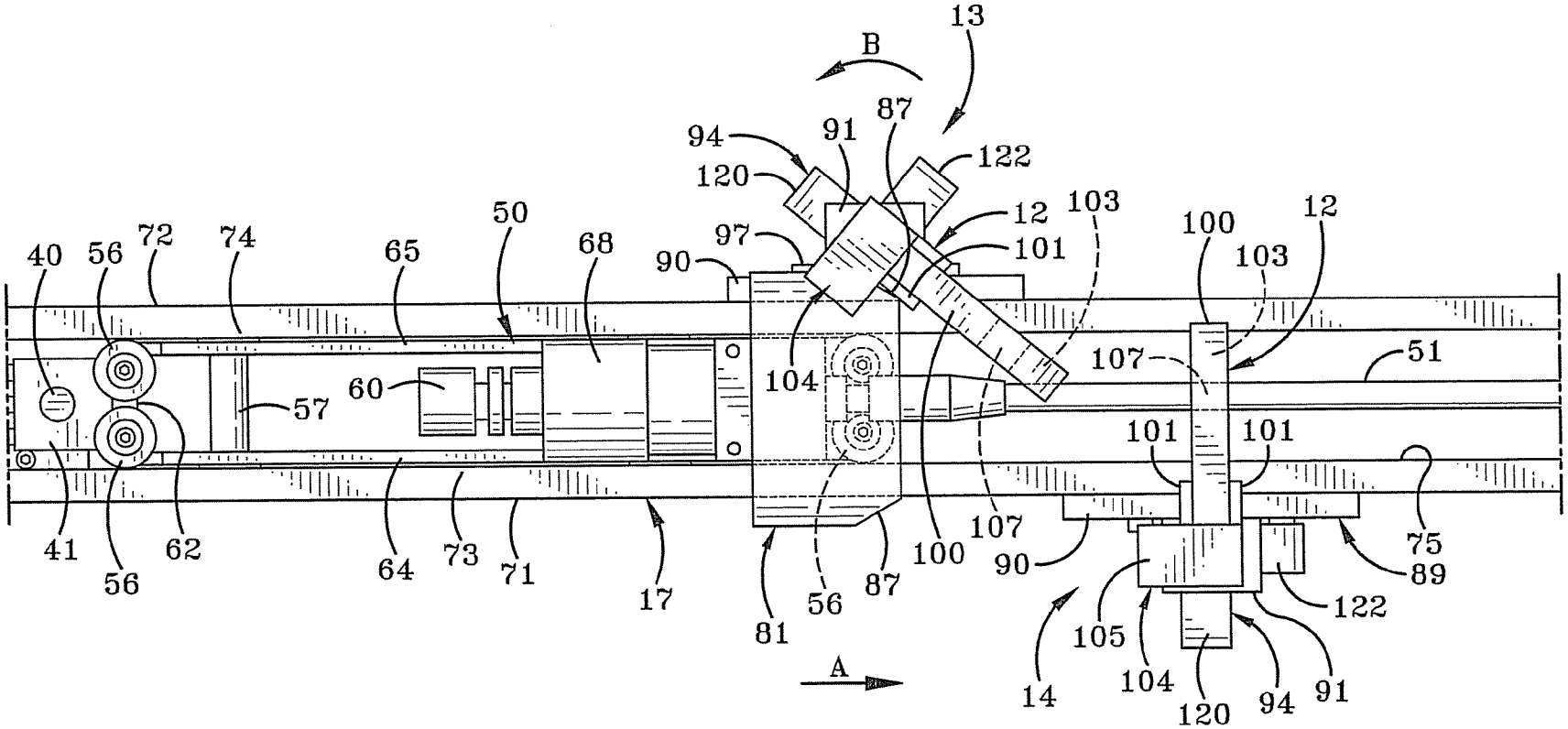
FIG. 16 illustrates an example top view of the lance cart of the preferred embodiment as it opens the door.
Figure 17:
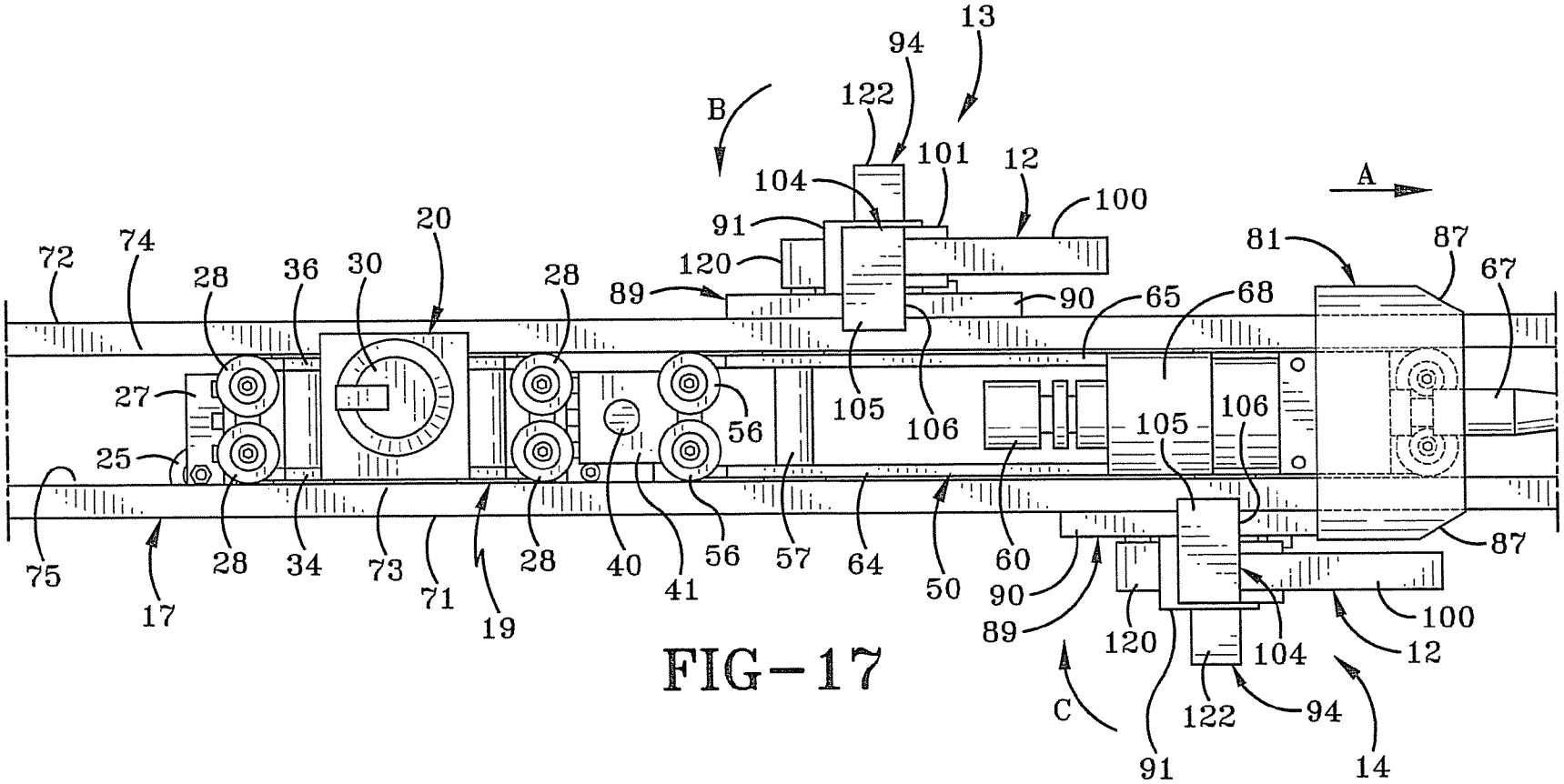
FIG. 17 illustrates an example top view of the lance cart of the preferred embodiment as it passes through two doors in the open position.

As the lance cart 50 progresses toward the front 6 of the rail 17 in the direction of arrow A it will reach the first door assembly 13 as shown in FIG. 15. As shown in FIGS. 14 and 15, the lance coupling 67 will make contact with the door 12 of door assembly 13 and begin pushing the door 12 open. As the door continues to open, eventually a beveled surface 87 of the bottom door pusher 81 will make contact with the door 12 to continue to push the door 12 open. This contact will eventually cause the magnetic attraction between the second magnets 96 and the second metal pegs 98 to be overcome and the door will begin to rotate in the direction of arrow B from the closed position toward the open position. As the door 12 is rotated open, eventually the first magnets 95 form an attractive force with the first metal pegs 97 to snap the door 12 of door assembly into the open position and to hold the door 12 in this position. FIG. 17 shows the lance cart 50 as it is passing the second door 14 with both doors assemblies 13, 14 in the open position. Notice that the second door assembly 14 on the opposite of the rail 17 than first door assembly 13 so that its door 12 will rotate in the direction of arrow C which is the opposite of arrow B. The bottom door pusher 81 continues to open doors in this manner until the lance 51 has been inserted sufficiently far into the elongated tube 4.

Figure 18:
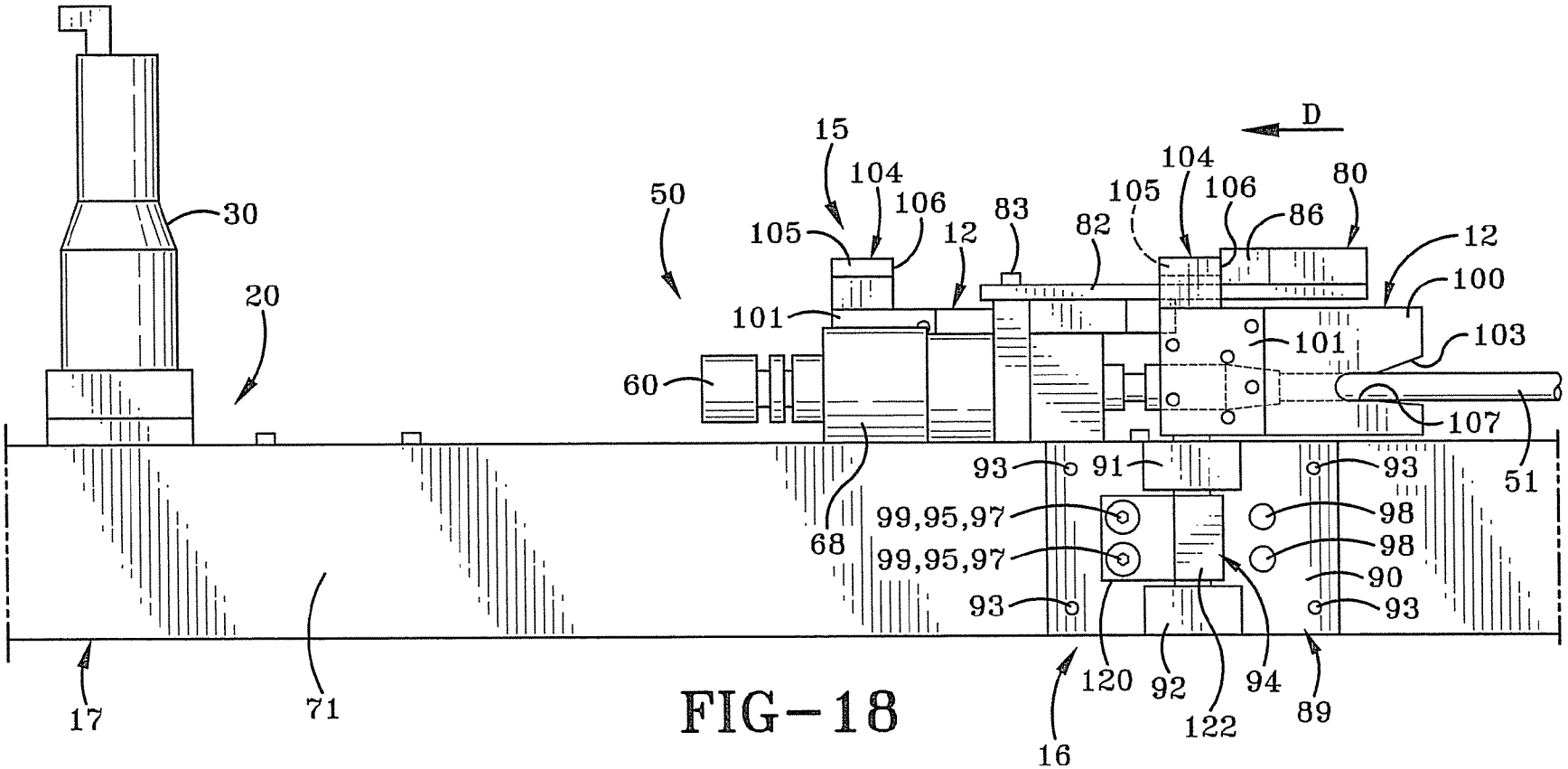
FIG. 18 illustrates an example side view of the lance cart of the preferred embodiment as it opens the door.
Figure 19:
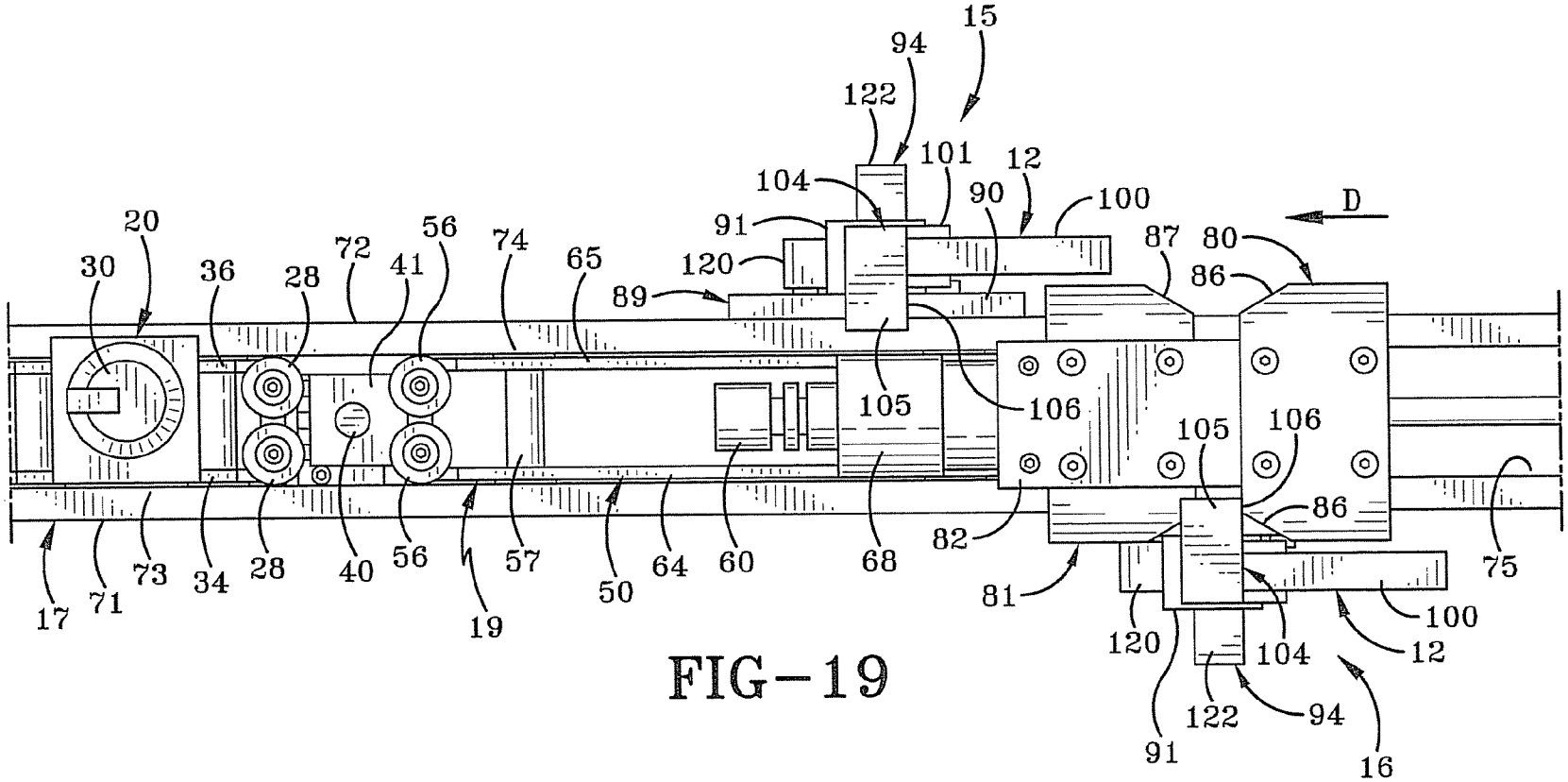
FIG. 19 illustrates an example top view of the lance cart of the preferred embodiment as it travels in the reverse direction.
Figure 20:
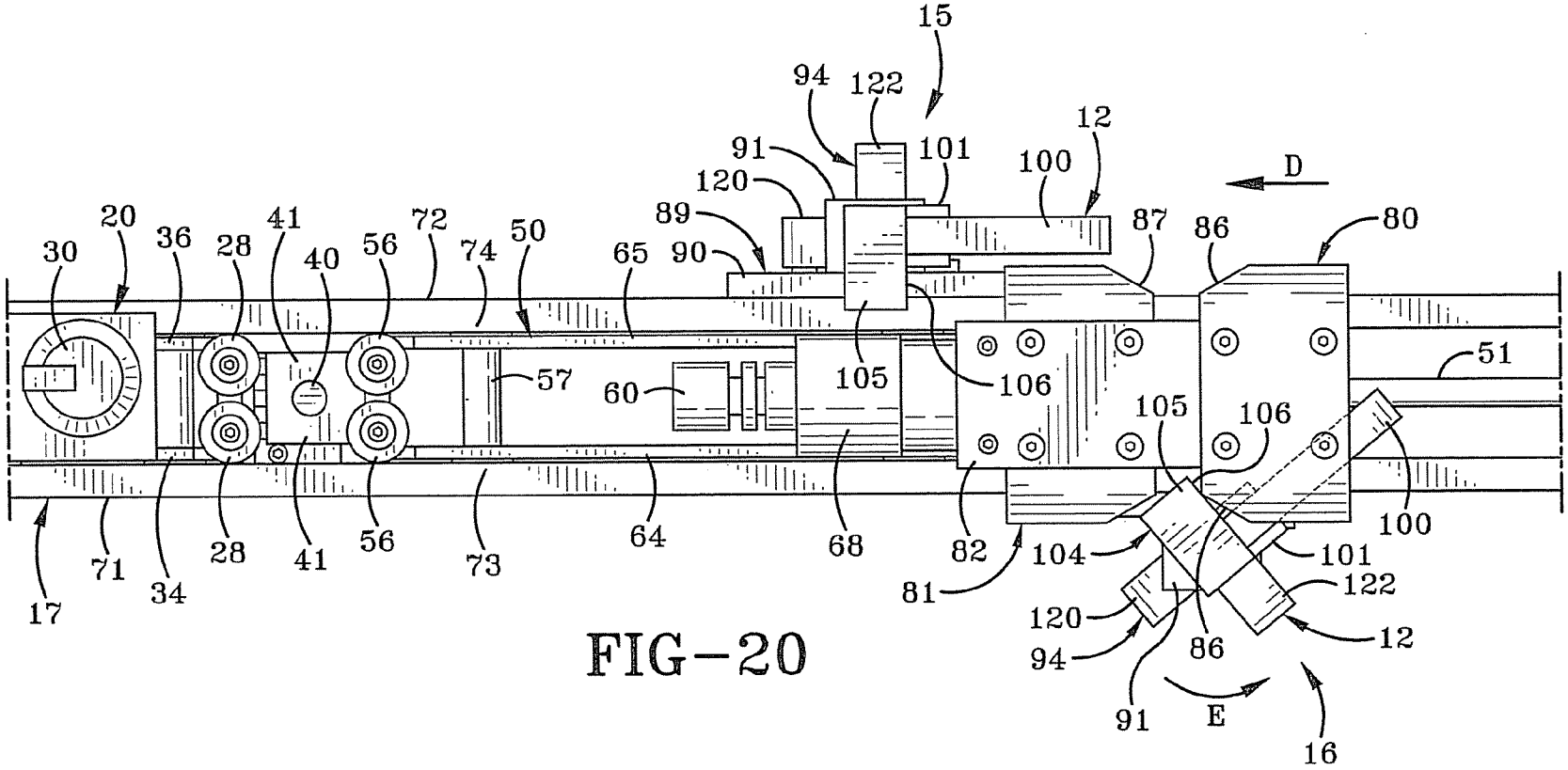
FIG. 20 illustrates an example top view of the lance cart of the preferred embodiment as it closes a door while traveling in the reverse direction.
Figure 21:
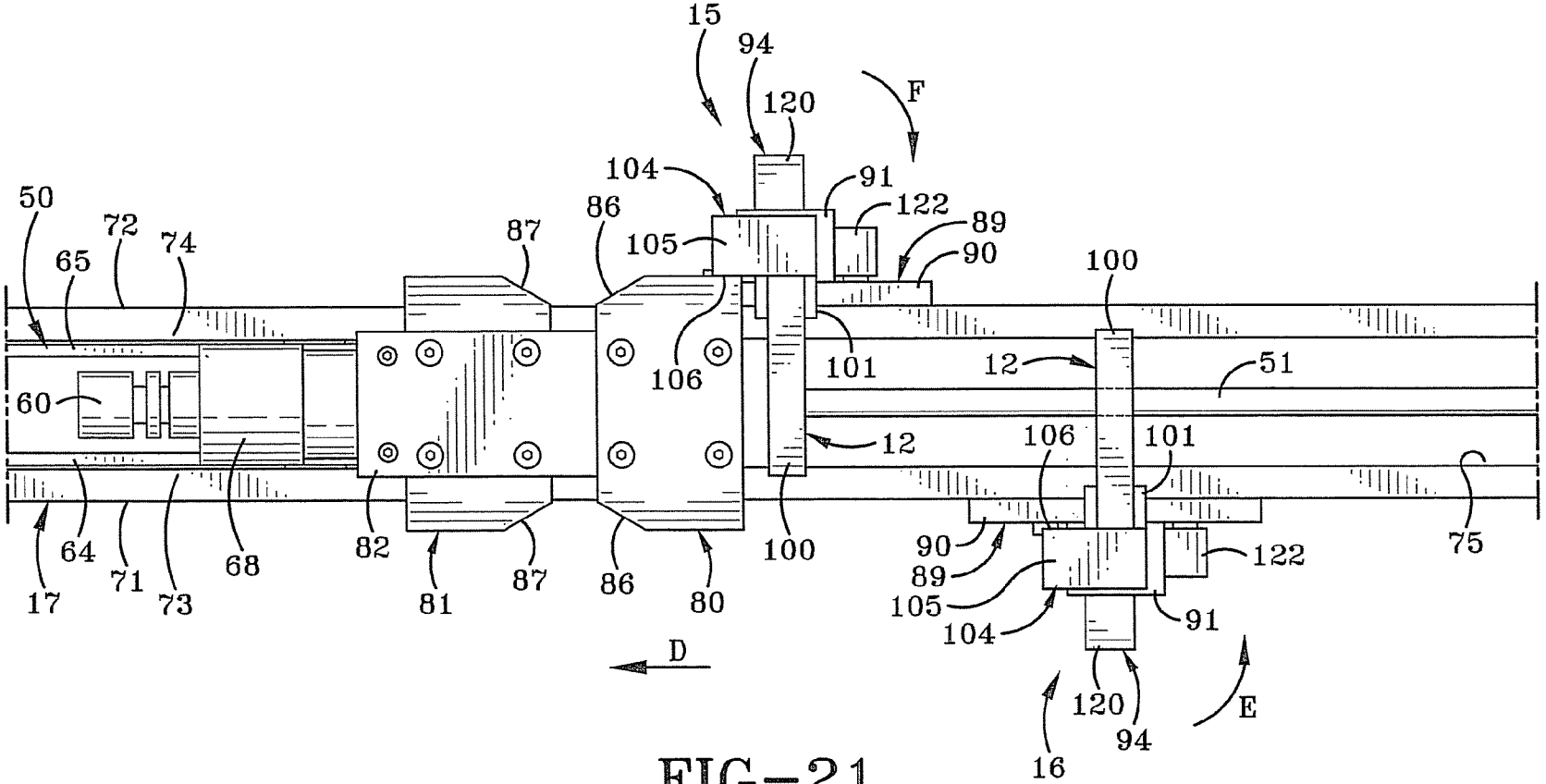
FIG. 21 illustrates an example top view of the lance cart of the preferred embodiment after it has closed two doors while traveling in the reverse direction.

After the lance 51 has been inserted sufficiently far into the elongated tube 4, the motor 30 will reverse direction and the two carts 20, 50 will begin to travel in the direction of Arrow D toward the back end 7 of the rail 17 as the lance 51 is withdrawn from the tube 4. As the lance cart 50 reaches the door 12 of door assembly 16 as shown in FIGS. 18 and 19, one of the beveled corners 87 of the top door pusher 80 will make contact with the second surface 106 of the pusher tab block 104. This contact will cause the magnetic attraction between the first magnets 95 and the first metal pegs 97 to be overcome and the door 12 of door assembly 16 will begin to rotate in the direction of arrow E (FIG. 20) from the open position toward the closed position. As the door 12 is rotated closed, eventually the second magnets 96 form an attractive force with the second metal pegs 98 to snap the door 12 of door assembly 16 into the closed position and continue to hold the door 13 in this position. FIG. 21 shows the lance cart 50 as it is passing door assembly 15 with both door assemblies 15, 16 in the closed position. The top door pusher 80 continues to close doors in this manner until the lance 51 has been sufficiently removed from the elongated tube 4.

Figure 22:
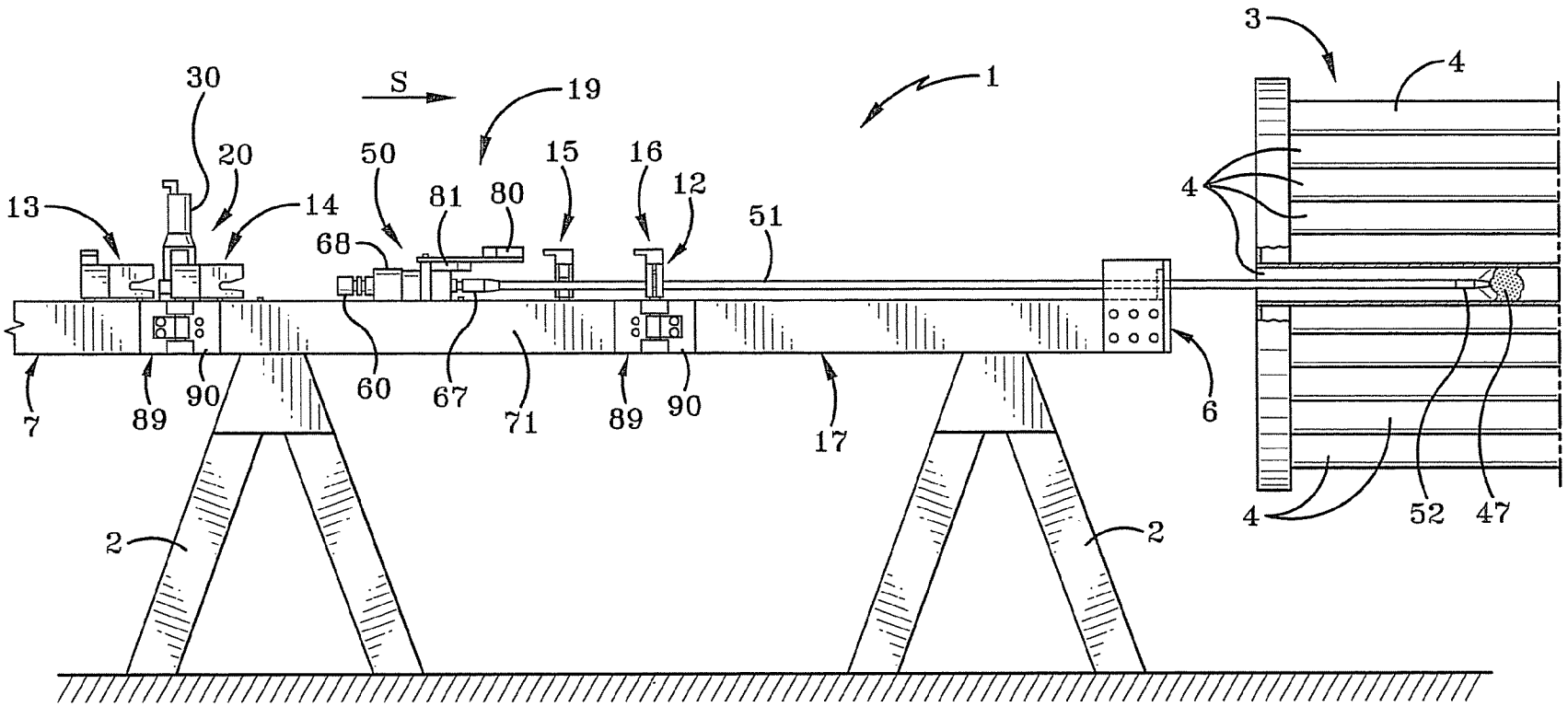
FIG. 22 illustrates an example side view of the apparatus of the preferred embodiment showing the lance traveling in the forward direction while encounter heavy material in the tube.
Figure 23:
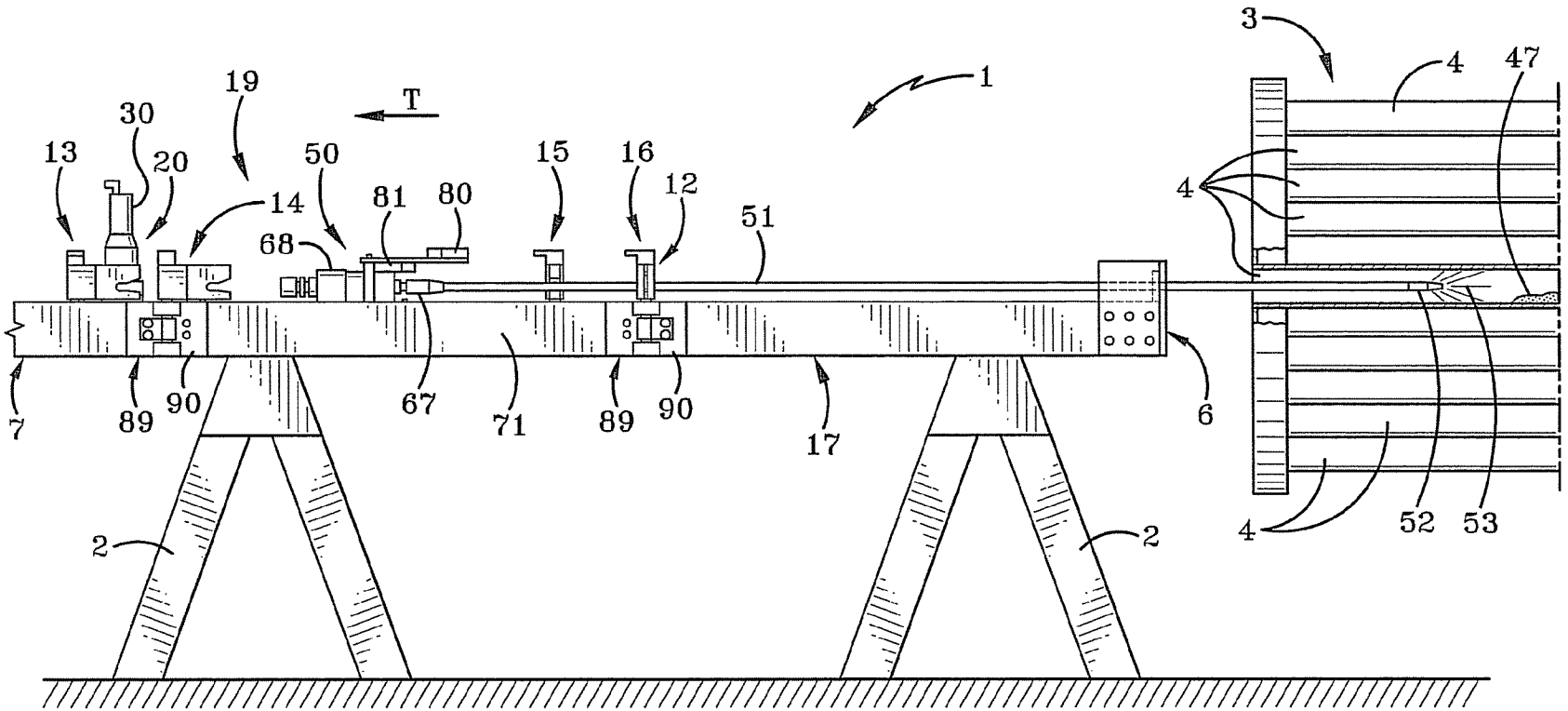
FIG. 23 illustrates an example side view of the apparatus of the preferred embodiment showing the lance traveling in the reverse direction after encountering heavy material in the tube.

In operation, as the lance cart 50 travels in a forward direction as shown by arrow S in FIG. 22 the lance may encounter enough dirt or grime built up inside the tube 4 that is difficult to blast out of the tube 4 by the lance 51, the pressure in the coupling 40 will cross a threshold level. When this happens, the controller 11 can cause the motorized cart 20 to run in the reverse direction as shown by arrow T in FIG. 23.

Figure 24:
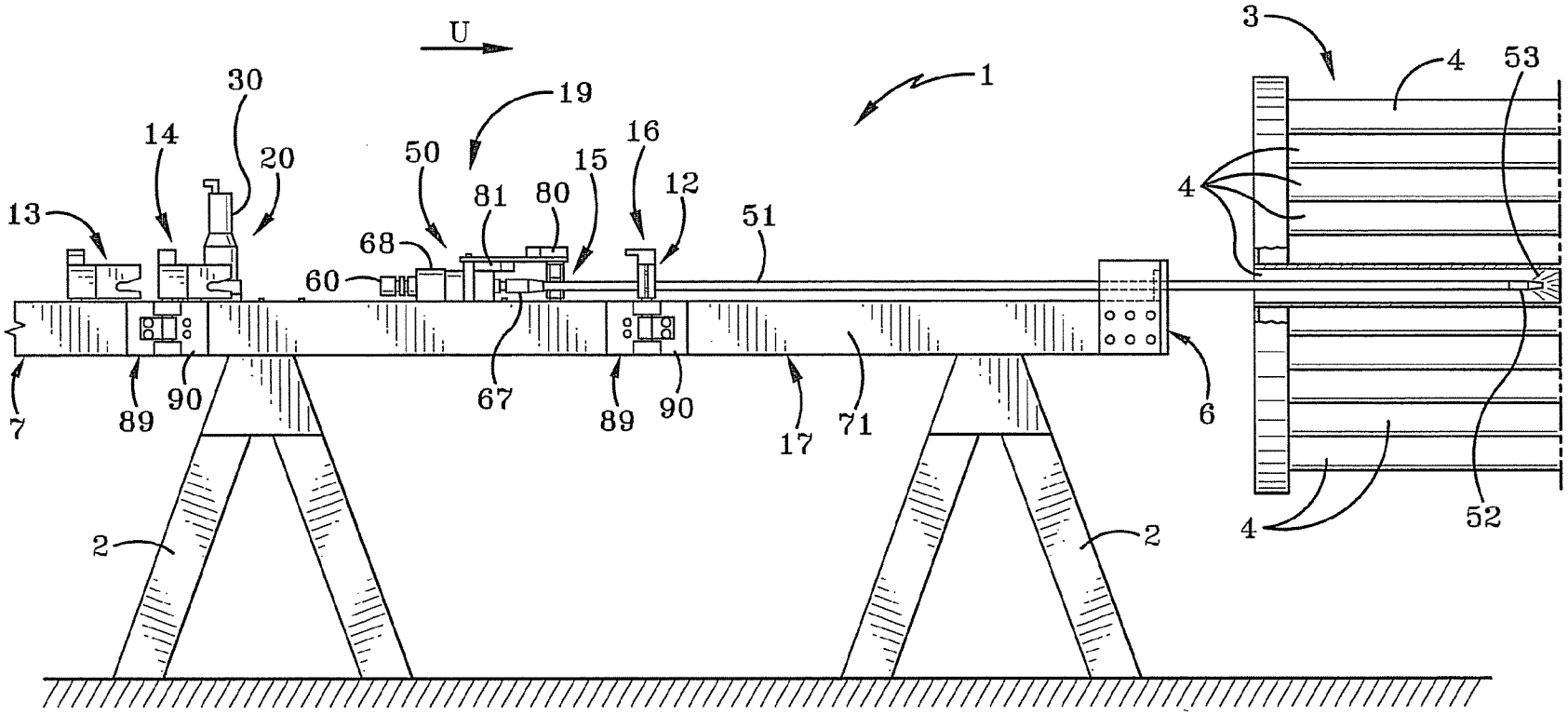
FIG. 24 illustrates an example side view of the apparatus of the preferred embodiment showing the lance traveling in the forward direction after traveling in the reverse direction after encountering heavy material in the tube.

Traveling in the reverse direction least partially pulls the lance 51 away from the heat exchanger 3. After the lance 51 is partial removed, the controller 11 can then signal for the motor 30 to run in the forward direction as shown by arrow U in FIG. 24 to begin re-inserting the lance 51 back into the heat exchanger 3. These actions can increase the chances of the apparatus 1 removing unwanted material that is tightly attached to the heat exchanger 3.

Figure 26:
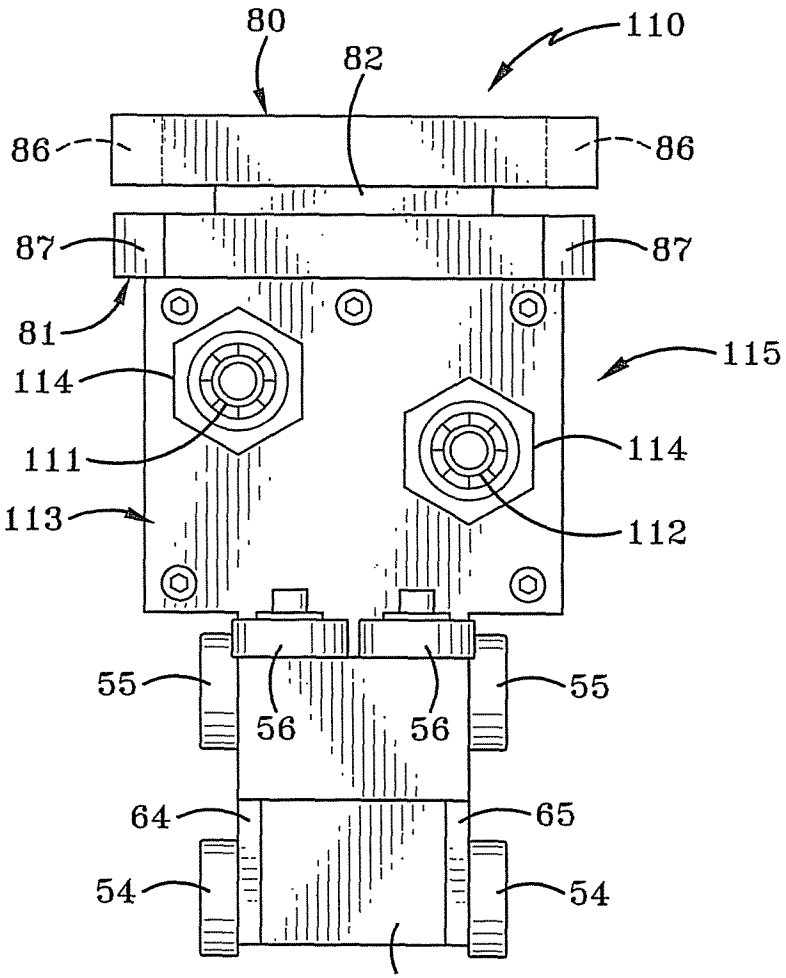
FIG. 26 illustrates an example front view of the lance cart of the preferred embodiment mounted with the dual lance.
Figure 4:
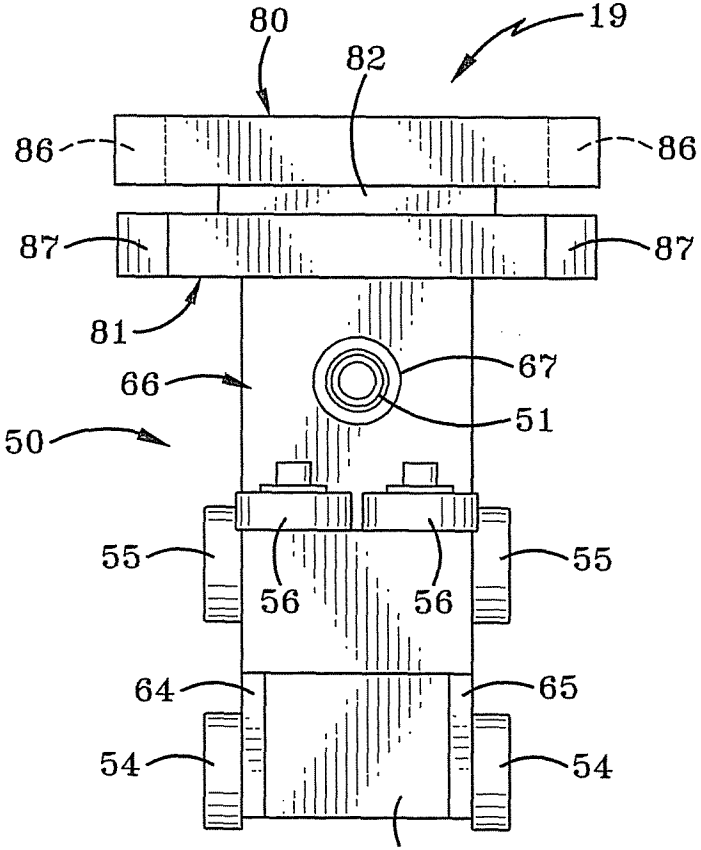
FIG. 4 illustrates an example front view of the lance cart of the preferred embodiment.
Figure 25:
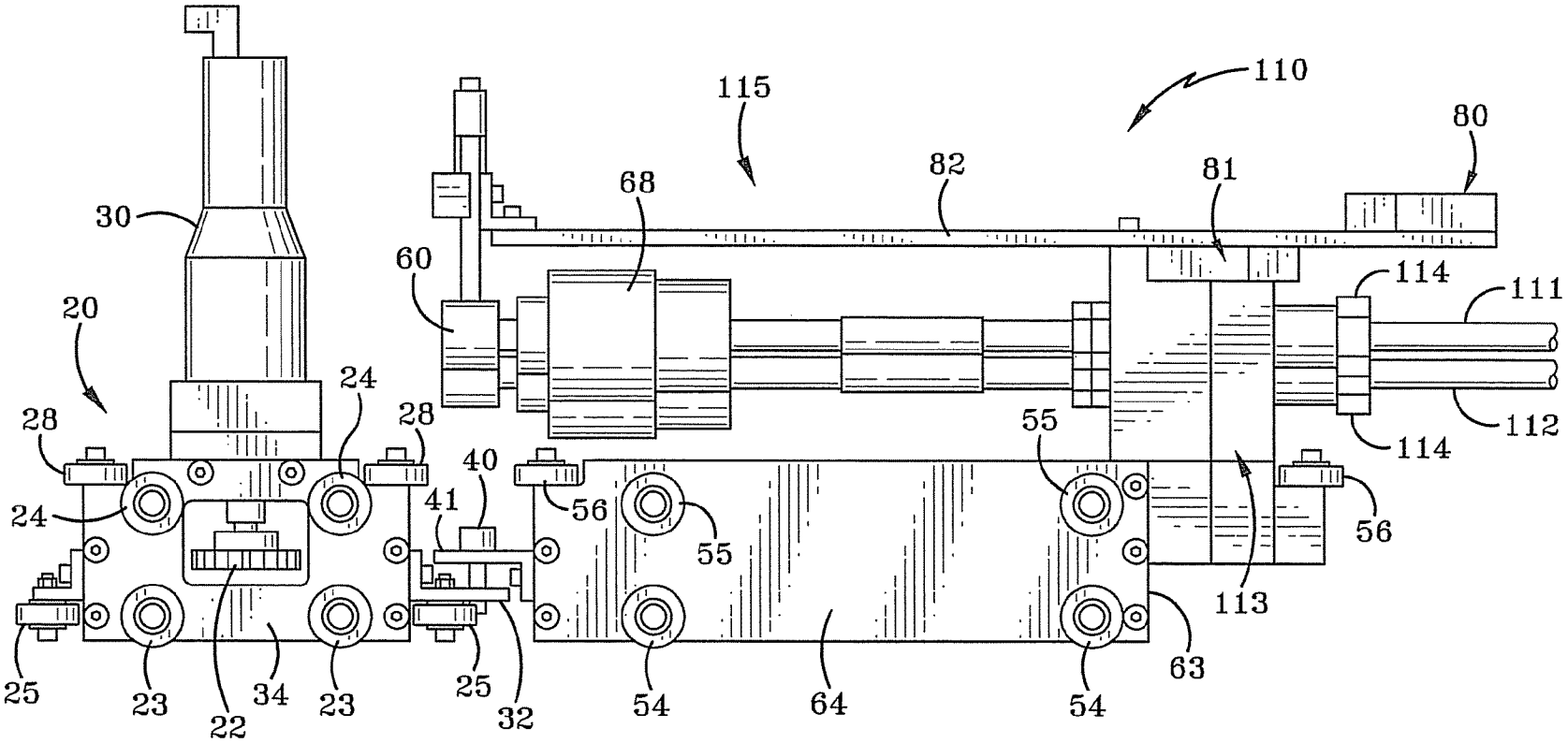
FIG. 25 illustrates an example side view of the lance cart of the preferred embodiment mounted with a dual lance.
Figure 27:
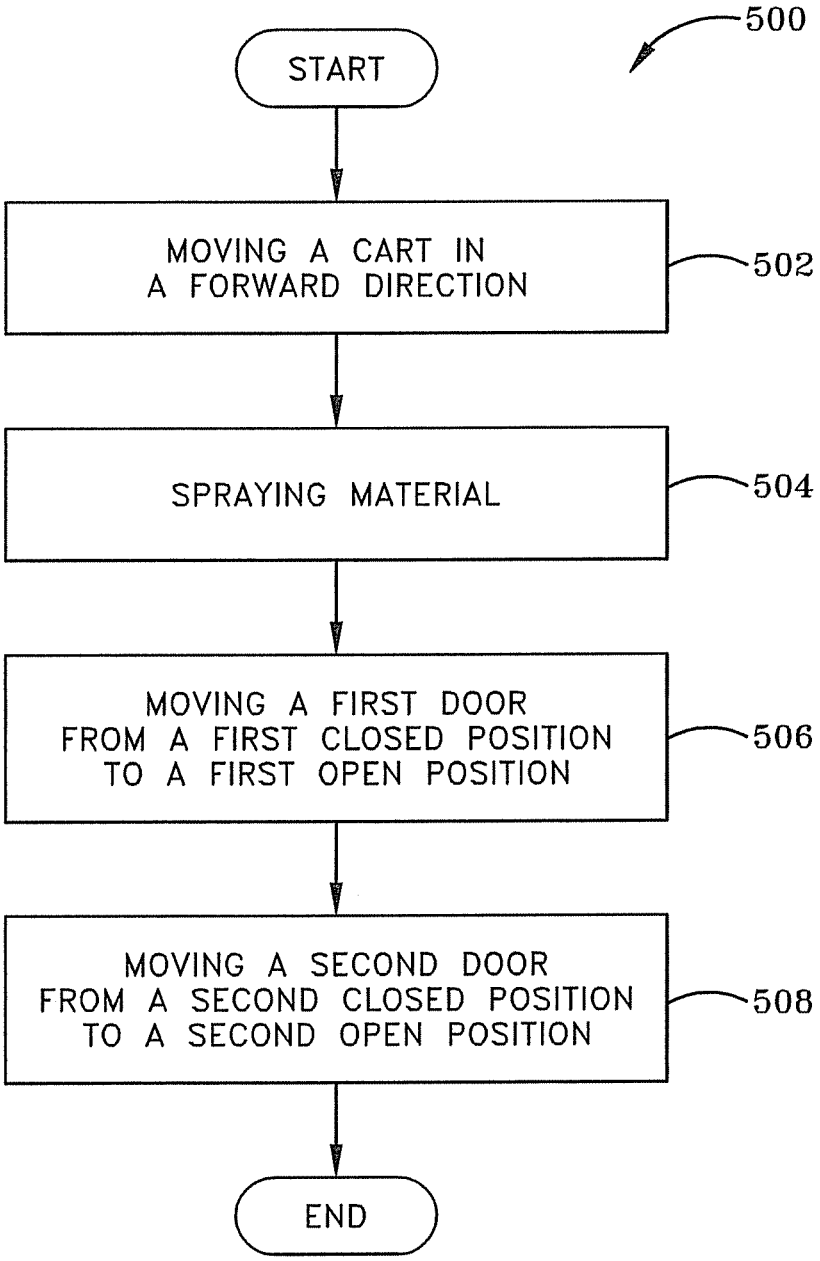
FIG. 27 illustrates configuration of the preferred embodiment as a method of cleaning elongated tubes.

In another configuration of the preferred embodiment, lance cart 50 of the apparatus 1 is mounted with a dual lance 100 as shown in FIGS. 25 and 26. The dual lance 100 contains a first lance 101 and a second lance 102. The dual lance connectors 114, gear box 113, drive assembly 68, and some other components of the single lance cart 50 may need to be modified and/or duplicated in the dual lance configuration. The dual lance is support on a dual lance cart 115 that is similar to the single lance cart 50. In operation, the first lance 101 can be inserted into a first tube 4 and the second lance 102 can be inserted into a second tube 4 to clean two tubes 4 at the same time. In one configuration of the preferred embodiment, the distance between the first lance 101 and the second lance 102 is adjustable so that tubes 4 with different diameters can be cleaned. Of course, in other configurations more than two lances can be mounted onto the lance cart 50.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

FIG. 28 illustrates a configuration of the preferred embodiment as a method 500 of cleaning elongated tubes such as the tubes in a heat exchanger. The method 500 begins by moving a cart, at 502, in a channel in a forward direction. The cart mounted with a lance sprays water or other material, at 504, at high pressure to clean grime and other unwanted material from the elongated tubes. The water is sprayed from the lance as the cart moves in the channel.

A first door is moved from a first closed position to a first open position, at 506, as the cart approaches the first door. A second door is moved from a second closed position to a second open position, at 508, as the cart approaches the second door. The second door is moved to the second open position after the first door is moved to the first open position.

When removing the lance from the tube, the cart is moved in the channel in a reverse direction. The second door is moved from the second open position to the second closed position as the cart approaches the second door in the reverse direction. The first door from the first open position to the second closed position as the cart approaches the first door in the reverse direction. The first door is moved to the first closed position after the second door is moved to the second closed position.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. An apparatus for cleaning elongated tubes comprising:

a lance for spraying material into elongated tubes to clean the elongated tubes;

a cart supporting the lance, wherein the cart is configured to move along a rail in a forward direction and in a reverse direction;

a pressure sensing device located in the cart configured to detect a pressure exerted on the cart as the cart moves in a forward direction in the rail; and a propulsion device configured to, upon the pressure sensing device detecting a pressure crossing a threshold value, propel the cart in the reverse direction for predetermined distance before again propelling the first cart in the forward direction.

2. The apparatus of claim 1 further comprising:

a top wheel attached to the cart adapted to make contact with a top edge of the rail; and a bottom wheel attached to the cart adapted to make with a bottom floor of the rail.

3. The apparatus of claim 2 further comprising:

a left side wheel attached to the cart adapted to make contact with a left side edge of the rail; and a right side wheel attached to the cart adapted to make contact with a right side edge of the rail.

4. The apparatus of claim 1 wherein the propulsion device is powered by at least one of the group of: water, air, electricity, magnetism, and electromagnetism.

5. The apparatus of claim 1 further comprising:

a door opener configured to open a door as the apparatus comes into contact with the door.

6. The apparatus of claim 5 further comprising:

a door closer configured to close the door as the apparatus passes back through the door in a direction opposite the apparatus moved when opening the door.

7. The apparatus of claim 6 wherein the door opener is at different height on the cart than the door closer.

8. The apparatus of claim 1 wherein the propulsion device further comprises:

a gear adapted to engage a gear rack on the rail to propel the apparatus along the rail.

9. The apparatus of claim 1 further comprising:

a gear box configured to spin the lance.

10. The apparatus of claim 1 wherein the cart is a first cart and further comprising:

a second cart with the propulsion device is mounted to the second cart and the lance is mounted in the first cart.

11. The apparatus of claim 1 further comprising:

a coupling connecting the first cart to the second cart, and wherein the pressure sensing device is adapted to detect a pressure at the coupling.

12. The apparatus of claim 1 wherein the lance is a first lance and further comprising:

a second lance mounted to the first cart adapted to spray a material into elongated to tubes to clean elongate tubes.

13. The apparatus of claim 12 wherein the first lance is parallel to the second lance.

14. The apparatus of claim 12, wherein the position between the first lance and second lance is adjustable.

15. The apparatus of claim 1 wherein the material the lance is adapted to spay into the elongated is water.

16. The apparatus of claim 1 wherein a cross-section of the rail is less than 6 inches by 6 inches.

17. An apparatus for cleaning elongated tubes comprising:

a rail with a door;

a lance for spraying material into elongated tubes to clean the elongated tubes, wherein when the door is in a closed position the door is adapted to support the lance;

a cart supporting the lance, wherein the cart is configured to move in the rail in a forward direction and in a reverse direction;

a pressure sensing device located in the cart configured to detect a pressure exerted on the cart as the cart moves in a forward direction in the rail; and a propulsion device configured to, upon the pressure sensing device detecting a pressure crossing a threshold value, propel the cart in the reverse direction for predetermined distance before again propelling the first cart in the forward direction.

18. The apparatus of claim 1 further comprising:

a door opening device on the cart adapted to open the door as the cart passes the door so that the door no longer supports the lance.

19. A method of cleaning elongated tubes comprising:

propelling a cart holding a lance through a rail in a forward direction;

spraying a material out of the lance to clean an elongated tube;

detecting a pressure applied to the cart that crosses a threshold value;

in response to the pressure crossing the threshold, stopping and backing the cart up in backward direction for a distance or a predetermined time; and after backing the cart up the distance, again moving the cart in the forward direction.

* * * * *